US006642175B2

(12) United States Patent
Mitsuo et al.

(10) Patent No.: US 6,642,175 B2
(45) Date of Patent: Nov. 4, 2003

(54) HEAT-SENSITIVE RECORDING MATERIAL

(75) Inventors: Hirofumi Mitsuo, Shizuoka-ken (JP); Tsutomu Watanabe, Shizuoka-ken (JP); Masayuki Iwasaki, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 127 days.

(21) Appl. No.: 09/968,904

(22) Filed: Oct. 3, 2001

(65) Prior Publication Data

US 2002/0065195 A1 May 30, 2002

(30) Foreign Application Priority Data

| | | |
|---|---|---|
| Oct. 3, 2000 | (JP) | 2000-303915 |
| Oct. 12, 2000 | (JP) | 2000-312250 |
| Oct. 20, 2000 | (JP) | 2000-321403 |
| Oct. 23, 2000 | (JP) | 2000-322268 |
| Oct. 24, 2000 | (JP) | 2000-323969 |
| Dec. 20, 2000 | (JP) | 2000-387793 |

(51) Int. Cl.[7] ..... B41M 5/30
(52) U.S. Cl. ..... 503/209; 503/208; 503/216
(58) Field of Search ..... 503/208, 209, 503/216

(56) References Cited

U.S. PATENT DOCUMENTS 4,482,905 A 11/1984 Kaneko et al.

FOREIGN PATENT DOCUMENTS

EP 0 997 315 A1 3/2000
EP 0 138 517 A2 10/2001

OTHER PUBLICATIONS

Japanese Abstract No. 02145560, dated Jun. 5, 1990.
Japanese Abstract No. 57212434, dated Dec. 27, 1982.

*Primary Examiner*—B. Hamilton Hess
(74) *Attorney, Agent, or Firm*—Sughrue Mion, PLLC

(57) ABSTRACT

A heat-sensitive recording material formed of a support having disposed thereon a heat-sensitive color-forming layer that includes an electron-donating leuco-dye and an electron-receiving compound, with the heat-sensitive color-forming layer including, N-(4-hydroxyphenyl)-p-toluenesulfonamide as the electron-donating leuco-dye. The heat-sensitive color-forming layer may include 2-benzyloxynaphthalene or a combination of 2-benzyloxynaphthalene and methylolstearic acid amide as a sensitizer, calcite-type precipitated calcium carbonate light and/or aluminium hydroxide as an inorganic pigment, polyvinyl alcohol having a degree of saponification of 85 to 99 mol % and a degree of polymerization of from 200 to 2000 as an adhesive, and 1,1,3-tris(2-methyl-4-hydroxy-5-tert-butylphenyl)butane and/or 1,1,3-tris(2-methyl-4-hydroxy-5-cyclohexylphenyl)butane as an image stabilizer. When the layer includes 2-benzyloxynaphthalene and methylolstearic acid amide, a ratio (x/y) of 2-benzyloxynaphthalene (x) to methylolstearic acid amide (y) is preferably 95/5 to 40/60. The support can be essentially waste pulp. The heat-sensitive recording material of the present invention may additionally include a protective layer including an inorganic pigment and a water-soluble polymer.

21 Claims, No Drawings

HEAT-SENSITIVE RECORDING MATERIAL

BACKGROUND OF THE INVENTION

1. Field of the Invention

The present invention relates to a heat-sensitive recording material, and in particular to a heat-sensitive recording material capable of forming high-density color images with little background fogging and having good image preservability.

2. Description of the Related Art

Heat-sensitive recording materials are widely used in the art because they are relatively inexpensive and capable of being processed in compact recording appliances not requiring specific maintenance. In order to increase the density of the color images to be formed on such heat-sensitive recording materials and to improve the image preservability of the materials, various studies are now being made relating to electron-donating leuco-dyes and electron-receiving compounds and to the layer constitution of heat-sensitive recording materials.

2,2-bis(4-hydroxyphenyl)propane (i.e., bisphenol A, referred to as "BPA") has been widely used as an electron-receiving compound with respect to electron-donating leuco-dyes used in such heat-sensitive recording materials. However, a heat-sensitive recording material having satisfactory sensitivity, ability to prevent background fogging, and good image preservability has not been obtained.

Japanese Patent Application Publication (JP-B) No. 2-25354 discloses a heat-sensitive recording paper in which N-(4-hydroxyphenyl)-p-toluenesulfonamide is used as an electron-receiving compound. However, with the advancement in recent years of high-speed thermal head printers, even such heat-sensitive recording papers are unsatisfactory in terms of sensitivity, ability to prevent background fogging, and also in terms of thermal head matching properties such as adhesion of contaminants to the thermal heads and abrading the thermal heads.

In addition, heat-sensitive recording materials generally have weak surface strength and inferior printability which gives rise to problems such as peeling of the paper during offset printing. In order to avoid such problems, it is possible to increase the amount of adhesive included in the heat-sensitive color-forming layer. However, increasing the amount of adhesive is problematic in that the color density of the heat-sensitive recording material is lowered. Thus, in order to solve these problems, there has been a strong demand for heat-sensitive recording materials that can ensure high color density and have good printability.

Further, inkjet printers have become widespread in offices as means for outputting from personal computers. Respective recording surfaces of the inkjet recording materials and heat-sensitive recording materials are often put together. However, conventional heat-sensitive recording materials are not satisfactorily resistant to ink for inkjet printers. Therefore, when the recording surface of the heat-sensitive recording material contacts the recording surface of the inkjet recording material, there has been the problem of fogging in the background area of the heat-sensitive recording material and density of the image area being lowered.

Moreover, due to a heightening awareness of the environment in recent years, there has been a demand for heat-sensitive recording materials that utilize supports in which waste pulp (so-called recycled paper) forms the main constituent. However, it has not always been the case that satisfactory heat-sensitive recording materials have been obtained, because background fogging and image preservability become worse as a result of using recycled paper as the support. In particular, when BPA is used as a developer for the recycled paper, background fogging and image preservability deteriorate.

Japanese Patent Application Laid-Open (JP-A) No. 3-140287 discloses a heat-sensitive recording material with which recording sensitivity is improved without attendant background contamination, and that can be applied to ultra-high speed printers as a result. This is due to the use of a recycled paper, wherein a measured value of a base paper by a regular reflection-type surface smoothness sensor under a pressure of 20 kg/cm$^2$ is no less than 8%. The heat-sensitive recording material disclosed in JP-A No. 3-140287 uses a developer comprising a phenol (such as bisphenol), a sulfone and a hydroxybenzoic acid. However, the image preservability of the heat-sensitive recording material is insufficient.

JP-A No. 4-21486 discloses obtaining a heat-sensitive recording material that has excellent recoloring potential (coloring after preservation), even when recycled paper is used as the support, by using as the developer bis(4-hydroxyphenyl)acetate-n-butyl, 4-hydroxy-4-isopropoxydiphenyl sulfone, 4,4'-thiobis(3-methyl-6-tert-butylphenol) or N,N'-diphenylthiourea. However, resistance to background fogging and image preservability of the heat-sensitive recording material disclosed in JP-A No. 4-21486 are still insufficient.

SUMMARY OF THE INVENTION

It is a first object of the present invention to provide a heat-sensitive recording material that ensures increased color density, little background fogging and good image preservability.

It is a second object of the present invention to provide a heat-sensitive recording material having good chemical resistance.

It is a third object of the present invention to provide a heat-sensitive recording material that well matches thermal heads, without leaving contaminants on the thermal heads and without abrading the thermal heads.

It is a fourth object of the present invention to provide a heat-sensitive recording material having good printability.

It is a fifth object of the present invention to provide a heat-sensitive recording material resistant to ink used in inkjet recording systems.

It is a sixth object of the present invention to provide a heat-sensitive recording material which comprises recycled paper of essentially waste pulp as the support and which therefore has the advantage of reducing the burden upon the environment.

It is a seventh object of the present invention to provide a heat-sensitive recording material having sticking resistance.

Specifically, the present invention provides a heat-sensitive recording material comprising support having disposed thereon a heat-sensitive color-forming layer that includes an electron-donating leuco-dye and an electron-receiving compound, wherein the heat-sensitive color-forming layer includes N-(4-hydroxyphenyl)-p-toluenesulfonamide as the electron-receiving compound and includes a sensitizer of 2-benzyloxynaphthalene.

With the heat-sensitive recording material comprising the above structure, color density is raised, there is little background fogging, and preservability of image areas and chemical resistance is excellent in comparison with conventional heat-sensitive recording materials.

The present invention also provides a heat-sensitive recording material comprising a support having disposed thereon a heat-sensitive color-forming layer that includes an electron-donating leuco-dye and an electron-receiving compound, wherein the heat-sensitive color-forming layer includes N-(4-hydroxyphenyl)-p-toluenesulfonamide as the electron-receiving compound and includes an inorganic pigment of calcite-type precipitated calcium carbonate light and/or aluminium hydroxide.

With the heat-sensitive recording material comprising the above structure, color density is raised, there is little background, preservability of image areas is excellent, and compatibility with thermal heads is excellent (contaminants do not adhere to the thermal heads and the thermal heads are not abraded) in comparison with conventional heat-sensitive recording materials.

The present invention also provides a heat-sensitive recording material comprising a support having disposed thereon a heat-sensitive color-forming layer that includes an electron-donating leuco-dye and an electron-receiving compound, wherein the heat-sensitive color-forming layer includes N-(4-hydroxyphenyl)-p-toluenesulfonamide as the electron-receiving compound and includes an adhesive of polyvinyl alcohol having a degree of saponification of 85 to 99 mol % and a degree of polymerization of 200 to 2000.

With the heat-sensitive recording material comprising the above structure, sensitivity is increased, there is little background fogging, and preservability of image areas and offset printability are improved in comparison with conventional heat-sensitive recording materials.

The present invention also provides a heat-sensitive recording material comprising a support having disposed thereon a heat-sensitive color-forming layer that includes an electron-donating leuco-dye and an electron-receiving compound, with a protective layer being disposed on the heat-sensitive color-forming layer, wherein the heat-sensitive color-forming layer includes N-(4-hydroxyphenyl)-p-toluenesulfonamide as the electron-receiving compound and the protective layer includes an inorganic pigment and a water-soluble polymer.

With the heat-sensitive recording material comprising the above structure, inkjet ink resistance and sensitivity are improved, there is little background fogging, and color image preservability is excellent.

The present invention also provides a heat-sensitive recording material comprising a support having disposed thereon a heat-sensitive color-forming layer that includes an electron-donating leuco-dye and an electron-receiving compound, wherein the heat-sensitive color-forming layer includes N-(4-hydroxyphenyl)-p-toluenesulfonamide as the electron-receiving compound and the support comprises essentially waste pulp.

Although recycled paper is used as the support, by using a specific developer, the heat-sensitive recording material of the present invention has well-balanced properties of high sensitivity, little background fogging and excellent image preservability.

The present invention also provides a heat-sensitive recording material comprising a support having disposed thereon a heat-sensitive color-forming layer that includes an electron-donating leuco-dye and an electron-receiving compound, wherein the heat-sensitive color-forming layer includes N-(4-hydroxyphenyl)-p-toluenesulfonamide as the electron-receiving compound, and includes, as a sensitizer, 2-benzyloxynaphthalene and methylolstearic acid amide, with a ratio (x/y) of the 2-benzyloxynaphthalene (x) to the methylolstearic acid amide (y) being 95/5 to 40/60, and includes, as an image stabilizer, 1,1,3-tris(2-methyl-4-hydroxy-5-tert-butylphenyl)butane and/or 1,1,3-tris(2-methyl-4-hydroxy-5-cyclohexylphenyl)butane.

With the heat-sensitive recording material comprising the above structure, color density is raised, there is little background fogging, and preservability of image areas, chemical resistance and sticking resistance are improved in comparison with conventional heat-sensitive recording materials.

DETAILED DESCRIPTION OF THE PREFERRED EMBODIMENTS

A heat-sensitive recording material of the present invention will be described below. The heat-sensitive recording material comprises a support having disposed thereon a heat-sensitive color-forming layer that includes an electron-donating leuco-dye and an electron-receiving compound, with the heat-sensitive color-forming layer including N-(4-hydroxyphenyl)-p-toluenesulfonamide as the electron-receiving compound. Conventional, well known supports can be used as the support in the present invention. Specifically, the support may comprise paper, such as woodfree paper, a paper to which a resin or pigment has been coated, resin-laminated paper, base paper having an undercoat layer (especially, woodfree paper having an undercoat layer), a synthetic paper, or a plastic film.

In order to improve thermal head matching property, base paper having an undercoat layer is preferable. A base paper to which an undercoat layer that includes an oil-absorbing pigment has been disposed with a blade coater is even more preferable. In this case, it is preferable that the Stoeckigt sizing degree of the support is at least 5 seconds.

As the above support, a smooth support having a surface smoothness of at least 300 seconds, as stipulated by JIS-P8119, is preferable from the standpoint of good dot reproducibility. More preferably, the degree of surface smoothness of the support falls between 300 seconds and 500 seconds.

A support including waste pulp as a main constituent, i.e., a support in which waste pulp occupies 50 wt. % of the support, can also be used.

Waste pulp is generally made from a combination of three steps:

(1) disaggregation, in which waste paper is processed by a pulper with chemicals and mechanical force to be disaggregated into fibers, whereby printed ink in the waste paper is separated from the fibers;

(2) removal of impurities, in which impurities (plastic, etc.) and other contaminants that were in the waste paper are removed; and (3) deinking, in which the ink separated from the fibers is removed from the system by floatation or washing.

If desired, the fibers may be bleached while they are deinked or in another step.

Using 100 wt. % of the waste pulp thus obtained, or using a mixture of the waste pulp combined less than 50 wt. % of virgin pulp, the support for the heat-sensitive recording material is formed according to ordinary processes.

From the standpoint of good dot reproducibility, a smooth support having a surface smoothness of at least 100 seconds, and preferably 150 seconds, as stipulated by JIS-P8119, is preferable as the support in which waste pulp forms the main constituent.

Moreover, the support used in the present invention may have an undercoat layer. The undercoat layer preferably has pigment as a main component. All general inorganic and organic pigments may be used. However, the pigment is preferably one having a degree of oil absorption of at least 40 ml/100 g (cc/100 g), as stipulated by JIS-K5101. Specific examples include calcium carbonate, magnesium carbonate, barium sulfate, aluminium oxide, aluminium hydroxide, kaolin, calcined kaolin, amorphous silica, calcined diatomaceous earth, aluminium silicate, magnesium aluminosilicate, and urea-formalin resin powder. Among these, calcined kaolin having a degree of oil absorption of 70 ml/100 g to 80 ml/100 g is preferred.

When these pigments are coated on the support, the amount of the pigment is preferably at least 2 g/m$^2$, more preferably at least 4 g/m$^2$, and even more preferably 7 g/m$^2$ to 12 g/m$^2$.

Examples of the binder used in the undercoat layer include water-soluble polymers and aqueous binders. These may be used singly, or in combination of two or more different.

Examples of the water-soluble polymer include starch, polyvinyl alcohol, polyacrylamide, carboxymethyl cellulose, methyl cellulose and casein.

The aqueous binder generally comprises synthetic rubber latex or synthetic resin emulsion. Examples thereof include styrene-butadiene rubber latex, acrylonitrile-butadiene rubber latex, methyl acrylate-butadiene rubber latex and vinyl acetate emulsion.

The amount of the binder used is determined in view of film strength of the coating layer and heat sensitivity of the heat-sensitivity color-forming layer. The amount of the binder with respect to the pigment added to the undercoat layer is 3 to 100 wt. %, preferably 5 to 50 wt. %, and more preferably 8 to 15 wt. %. The undercoat layer may also include, for example, wax, color erasure inhibitors and surfactants.

Any known coating method can be employed to apply the undercoat layer. Specifically, methods can be used that use air-knife coaters, roll coaters, blade coaters, gravure coaters, and curtain coaters. Among these, methods that use blade caters are preferable. Further, a smoothing treatment such as calendering may also be administered to the undercoat layer as needed.

Methods that use blade coaters are not limited to methods that used bevel blade coaters or vented blade coaters, and include methods that use rod blade coaters and bill blade coaters. These methods are also not limited to off-machine coaters. The undercoat layer may be applied by an on-machine coater disposed in a papermaking machine. For enhancing flowability when the undercoat layer is applied by the blade coater, and to obtain excellent smoothness and planar shape, carboxymethyl cellulose having a degree of etherification of 0.6 to 0.8 and a weight-average molecular weight of 20000 to 200000 may be added to the coating liquid at 1% to 5% by weight, preferably 1% to 3% by weight, with respect to the pigment.

The heat-sensitive color-forming layer formed on the support includes at least an electron-donating leuco-dye and an electron-receiving compound, and may optionally include sensitizers, inorganic pigments, image stabilizers, adhesives, UV absorbents and crosslinking agents.

The electron-donating leuco-dye is preferably at least one selected from 2-anilino-3-methyl-6-diethylaminofluoran, 2-anilino-3-methyl-6-(N-ethyl-N-isoamylamino)fluoran and 2-anilino-3-methyl-6-(N-ethyl-N-propylamino)fluoran. These may be used singly, or two or more may be used in combination.

By using at least one selected from 2-anilino-3-methyl-6-diethylaminofluoran, 2-anilino-3-methyl-6-(N-ethyl-N-isoamylamino)fluoran and 2-anilino-3-methyl-6-(N-ethyl-N-propylamino)fluoran as the electron-donating leuco-dye, color density, preservability of image areas and chemical resistance can be further improved.

In addition to the above, for example, 3-di(n-butylamino)-6-methyl-7-anilinofluoran, 2-anilino-3-methyl-6-N-ethyl-N-sec-butylaminofluoran, 3-di(n-pentylamino)-6-methyl-7-anilinofluoran, 3-(N-isoamyl-N-ethylamino)-6-methyl-7-anilinofluoran, 3-(N-n-hexyl-N-ethylamino)-6-methyl-7-anilinofluoran, 3-[N-(3-ethoxypropyl)-N-ethylamino]-6-methyl-7-anilinofluoran, 3-di(n-butylamino)-7-(2-chloroanilino)fluoran, 3-diethylamino-7-(2-chloroanilino)fluoran, 3-diethylamino-6-methyl-7-anilinofluoran, and 3-(N-cyclohexyl-N-methylamino)-6-methyl-7-anilinofluoran may also be used as the electron-donating leuco-dye.

Other than 2-anilino-3-methyl-6-diethylaminofluoran, and the like, from the standpoint of background fogging of non-image areas, 3-di(n-butylamino)-6-methyl-7-anilinofluoran, 2-anilino-3-methyl-6-N-ethyl-N-sec-butylaminofluoran and 3-diethylamino-6-methyl-7-anilinofluoran are preferable as the electron-donating leuco-dye.

The coating amount of the electron-donating leuco-dye is preferably 0.1 to 1.0 g/m$^2$, and more preferably 0.2 and 0.5 g/m$^2$ in view of color density and background fogging density.

The heat-sensitive recording material of the present invention includes N-(4-hydroxyphenyl)-p-toluenesulfonamide as the electron-receiving compound. By including N-(4-hydroxyphenyl)-p-toluenesulfonamide as the electron-receiving compound, color density is raised, background fogging is reduced and preservability of image areas is improved.

The amount of the electron-receiving compound is preferably 50 to 400% by weight, more preferably 10 to 300% by weight, and even more preferably 100 to 300% by weight with respect to the electron-donating leuco-dye.

Well known electron-receiving compounds other than N-(4-hydroxyphenyl)-p-toluenesulfonamide may also be used together therewith as the electron-receiving compound in the present invention as long as the effects of the present invention are not compromised.

Although any electron-receiving compound may be suitably selected for use in the invention, phenolic compounds or salicylic acid derivatives and their polyvalent metal salts are preferable from the standpoint of preventing background fogging.

Examples of the phenolic compounds include 2,2'-bis(4-hydroxyphenol)propane (bisphenol A), 4-t-butylphenol, 4-phenylphenol, 4-hydroxy-diphenoxide, 1,1'-bis(4-hydroxyphenyl)cyclohexane, 1,1'-bis(3-chloro-4-hydroxyphenyl)cyclohexane, 1,1'-bis(3-chloro-4-hydroxyphenyl)-2-ethylbutane, 4,4'-sec-isooctylidene-diphenol, 4,4'-sec-butylidene-diphenol, 4-tert-octylphenol, 4-p-methylphenylphenol, 4,4'-methylcyclohexylidene-phenol, 4,4'-isopentylidene-phenol, 4-hydroxy-4-isopropyloxydiphenyl sulfone, benzyl p-hydroxybenzoate, 4,4'-dihydroxydiphenyl sulfone, and 2,4'-dihydroxydiphenyl sulfone.

Examples of the salicylic acid derivatives and their polyvalent metal salts include 4-pentadecylsalicylic acid, 3,5-di(α-methylbenzyl)salicylic acid, 3,5-di(tert-octyl)salicylic acid, 5-octadecylsalicylic acid, 5-α-(p-α-methylbenzylphenyl)ethylsalicylic acid, 3-α-methylbenzyl- 5-tert-octylsalicylic acid, 5-tetradecylsalicylic acid, 4-hexyloxysalicylic acid, 4-cyclohexyloxysalicylic acid, 4-decyloxysalicylic acid, 4-docecyloxysalicylic acid, 4-pentadecyloxysalicylic acid, 4-octadecyloxysalicylic acid, and their salts with zinc, aluminium, calcium, copper or lead.

When N-(4-hydroxyphenyl)-p-toluenesulfonamide is used together with any of the above-mentioned known electron-donating compounds, the amount of N-(4-hydroxyphenyl)-p-toluenesulfonamide is preferably at least 50% by weight, more preferably at least 70% by weight of the total of the electron-donating compounds.

In preparing the coating liquid for the heat-sensitive color-forming layer, the volume-average particle diameter of the particles of the electron-donating compound is preferably at most 1.0 μm, more preferably 0.4 to 0.7 μm, and even more preferably 0.5 to 0.7 μm. If the volume-average particle diameter of the particles exceeds 1.0 μm, sometimes the heat sensitivity is lowered. The volume-average particle diameter can be readily measured with a laser-diffractometric particle size distribution analyzer (e.g., LA500, manufactured by Horiba).

The heat-sensitive color-forming layer in the heat-sensitive recording material of the present invention may include a sensitizer. Examples thereof include 2-benzyloxynaphthalene, aliphatic monoamides such as stearic acid amides (especially, methylolstearic acid amide) and palmitic acid amides, as well as stearylurea, p-benzylbiphenyl, di(2-methylphenoxy)ethane, di(2-methoxyphenoxy)ethane, β-naphthol (p-methylbenzyl) ether, α-naphthyl benzyl ether, 1,4-butanediol p-methylphenyl ether, 1,4-butanediol p-isopropylphenyl ether, 1,4-butanediol p-tert-octylphenyl ether, 1-phenoxy-2-(4-ethylphenoxy)ethane, 1-phenoxy-2-(chlorophenoxy) ethane, 1,4-butanediol phenyl ether, diethylene glycol bis (4-methoxyphenyl) ether, m-terphenyl, methyl oxalate benzyl ether, 1,2-diphenoxymethylbenzene, and 1,2-bis(3-methylphenoxy)ethane, 1,4-bis(phenoxymethyl)benzene. By including such sensitizers, the sensitivity of the recording material is significantly increased. Among the above sensitizers, 2-benzyloxynaphthalene and aliphatic monoamides are preferable, and 2-benzyloxynaphthalene is particularly preferable. When 2-benzyloxynaphthalene and methylolstearic acid amide are included, it is possible to greatly improve sensitivity while suppressing generation of background fogging.

The amount of the sensitizer added is preferably 75 to 200 parts by weight, and more preferably 100 to 150 parts by weight, relative to 100 parts by weight of N-(4-hydroxyphenyl)-p-toluenesulfonamide, which is the electron-receiving compound. When the amount of the sensitizer is within the range of 75 to 200 parts by weight, the effects of improved sensitivity become more pronounced and image preservability is also good.

When 2-benzyloxynaphthalene and methylolstearic acid amide are included, the ratio (x/y) of 2-benzyloxynaphthalene (x) to methylolstearic acid amide (y) by weight is preferably 95/5 to 40/60. When the ratio is smaller than 95/5 or is greater than 40/60, in either case sensitivity becomes low. The ratio by weight is more preferably 90/10 to 50/50, and even more preferably 85/15 to 70/30.

The heat-sensitive color-forming layer in the heat-sensitive recording material of the present invention may include as an inorganic pigment calcium carbonate (e.g., calcite-type, cubic system), aluminium hydroxide, barium sulfate, magnesium carbonate, magnesium oxide, lithopone, agalmatolite, kaolin, calcined kaolin and amorphous silica.

Among these, basic pigments such as calcium carbonate, aluminium hydroxide, basic magnesium carbonate and magnesium oxide are preferably used, from the standpoint of obtaining a heat-sensitive recording material in which there is little background fogging. When calcite-type precipitated calcium carbonate light and/or aluminium hydroxide are included, there is little background fogging, little abrading of the thermal head, little contaminants adhere to the thermal head them and sticking resistance is improved.

Precipitated calcium carbonate light is preferable. The crystal form of the precipitated calcium carbonate light is generally, for example, calcite (burr-like configuration), aragonite or vaterite. However, calcite-type precipitated calcium carbonate light is preferable in view of absorbability, hardness and color density when recorded by a thermal head. Calcite-type precipitated calcium carbonate light whose particle shapes are spindle-like or scalenohedral is even more preferable.

Well known methods can be used to manufacture the calcite-type precipitated calcium carbonate light.

The amount of the inorganic pigment to be in the heat-sensitive color-forming layer is preferably 50 to 250 parts by weight, more preferably 70 to 170 parts by weight, and even more preferably 90 to 140 parts by weight, relative to 100 parts by weight of the electron-receiving compound in the layer, in view of color density and reducing adhesion of contaminants to the thermal head. The amount of the pigment is preferably 50 to 1000% by weight, and more preferably 100 to 500% by weight, with respect to the electron-donating leuco-dye.

With respect to the particle diameter of the inorganic pigment, the volume-average particle diameter is preferably 0.6 to 2.5 μm, more preferably 0.8 to 2.0 μm, and even more preferably 1.0 to 1.6 μm, in view of color density and reducing adhesion of contaminants to the thermal head. Moreover, a burr-like (calcite-type) calcium carbonate having a particle diameter of 1 to 3 μm can be preferably used. Further, kaolin having a particle diameter 1 to 3 μm can also be preferably used. The mean particle diameter of the other pigments such as aluminium hydroxide is preferably within the range of 0.3 to 1.5 μm, and more preferably 0.5 to 0.9 μm.

When calcite-type precipitated calcium carbonate light (x) and aluminium hydroxide (y) are used together, the weight ratio (x/y) is preferably 80/20 to 20/80, and more preferably 60/40 to 40/60.

When calcite-type precipitated calcium carbonate light and aluminium hydroxide are combined with other inorganic pigments, it is preferable that the ratio (v/w) by weight of the total amount (v) of calcite-type precipitated calcium carbonate light and aluminium hydroxide to the total amount (w) of the other inorganic pigments is 100/0 to 60/40, and more preferably 100/0 to 80/20.

It is also preferable for basic magnesium carbonate and magnesium oxide to be combined with other pigments and used, in view of background fogging. In this case, the amount of basic magnesium carbonate and magnesium oxide is preferably 3 to 50% by weight, and more preferably 5 to 30% by weight, of the total pigments.

The heat-sensitive color-forming layer may include as an adhesive polyvinyl alcohol (hereinafter, sometimes referred to as "PVA") having a degree of saponification of 85 to 99 mol % and a degree of polymerization of 200 to 2000. By including such PVA as an adhesive in the heat-sensitive color-forming layer, adhesion between the heat-sensitive color-forming layer and the support is increased and problems such as paper peeling that arise during offset printing are prevented, whereby printability is improved.

PVA that has a degree of saponification of 85 to 99 mol % can be used in the present invention. When the degree of saponification of the PVA is less than 85 mol %, resistance to moisture used in offset printing is insufficient and it becomes easy for paper peeling to occur. Alternatively, when the amount of PVA added is increased in order to prevent paper peeling, color density is lowered. Further, when the degree of saponification exceeds 99 mol %, it becomes easy for undissolved matter to arise at the time the coating solution is prepared, which leads to defects and is therefore undesirable.

PVA that has a degree of polymerization within the range of 200 to 2000 can also be used in the present invention. When the degree of polymerization of the PVA is less than 200, it becomes easy for paper peeling to occur at the time of offset printing. When the amount of PVA added is increased in order to prevent paper peeling, color density is lowered. When the degree of polymerization exceeds 2000, it becomes difficult for the PVA to be dissolved in the solvent and the viscosity of the coating solution increases, whereby it becomes difficult to prepare and coat the coating solution. The degree of polymerization referred to herein indicates a mean degree of polymerization measured by methods disclosed in JIS-K6726 (1994).

The PVA content in the heat-sensitive color-forming layer is preferably 30 to 300 parts by weight relative to 100 parts by weight of the electron-donating leuco-dye, in view of color density and offset printability of the recording material (no paper peeling, etc.). The PVA content is more preferably 70 and 200 parts by weight, and even more preferably 100 to 170 parts by weight. The PVA in the heat-sensitive color-forming layer of the present invention acts not only as an adhesive for increasing adhesion between the support and the heat-sensitive color-forming layer, but also as a dispersant and a binder.

Any PVA that having a degree of saponification of 85 to 99 mol % and a degree of polymerization of 200 and 2000 can be suitable used. However, at least one selected from sulfo-modified polyvinyl alcohol, diacetone-modified polyvinyl alcohol and acetoacetyl-modified polyvinyl alcohol is preferable in view of color density in recording by a thermal head.

The sulfo-modified polyvinyl alcohol, diacetone-modified polyvinyl alcohol and acetoacetyl-modified polyvinyl alcohol may be used either singly or in combination, or may be further combined with another PVA. When combined with another PVA, the amount of sulfo-modified polyvinyl alcohol, diacetone-modified polyvinyl alcohol and/or acetoacetyl-modified polyvinyl alcohol is preferably at least 10% by weight, and more preferably at least 20% by weight, with respect to the total amount of the PVA.

The sulfo-modified polyvinyl alcohol can be prepared by several different methods, such as: a method in which an olefinsulfonic acid or its salt, such as ethylenesulfonic acid, allylsulfonic acid or methallylsulfonic acid, is polymerized with a vinyl ester such as vinyl acetate in an alcohol or in a mixed solvent of alcohol/water, followed by saponifying the resultant polymer; a method in which a sulfonamide sodium salt is copolymerized with vinyl ester such as vinyl acetate, followed by saponifying the resultant copolymer; a method in which a PVA is treated with bromine or iodine, followed by heating the treated PVA in an aqueous solution of acidic sodium sulfite; a method in which a PVA is heated in an aqueous solution of concentrated sulfuric acid; and a method in which a PVA is acetalyzed with an aldehyde compound having a sulfonic acid group.

The diacetone-modified polyvinyl alcohol is a partially or completely saponified product of a copolymer of a vinyl ester and a monomer having a diacetone group. The diacetone-modified polyvinyl alcohol is prepared, for example, by saponifying a resin obtained by copolymerizing a vinyl ester and a monomer having a diacetone group.

In the diacetone-modified polyvinyl alcohol, there are no particular limitations on the amount of the monomer having the diacetone group (repetitive unit structure).

The acetoacetyl-modified polyvinyl alcohol is generally prepared by adding a liquid or gaseous diketene to a solution, dispersion or powder of polyvinyl alcohol resin and reacting them. The degree of acetylation of the acetoacetyl-modified polyvinyl alcohol can be suitably determined in accordance with the desired quality of the heat-sensitive recording material.

The heat-sensitive color-forming layer may also include image stabilizers and UV absorbents.

For the image stabilizer, phenolic compounds, especially hindered phenol compounds are effective. Example thereof include 1,1,3-tris(2-methyl-4-hydroxy-5-tert-butylphenyl)butane, 1,1,3-tris(2-ethyl-4-hydroxy-5-cyclohexylphenyl)butane, 1,1,3-tris(2-methyl-4-hydroxy-5-cyclohexylphenyl)butane, 1,1,3-tris(3,5-di-tert-butyl-4-hydroxyphenyl)butane, 1,1,3-tris(2-methyl-4-hydroxy-5-tert-butylphenyl)propane, 2,2'-methylene-bis(6-tert-butyl-4-methylphenol), 2,2'-methylene-bis(6-tert-butyl-4-ethylphenol), 4,4'-butylidene-bis(6-tert-butyl-3-methylphenol), and 4,4'-thio-bis(3-methyl-6-tert-butylphenol). Among these, 1,1,3-tris(2-methyl-4-hydroxy-5-tert-butylphenyl)butane is preferable. A combination of 1,1,3-tris(2-methyl-4-hydroxy-5-tert-butylphenyl)butane and 1,1,3-tris(2-methyl-4-hydroxy-5-cyclohexylphenyl)butane is also preferable. When the heat-sensitive color-forming layer includes N-(4-hydroxyphenyl)-p-toluenesulfonamide and 2-benzyloxynaphthalene, background fogging is reduced by the interaction between the image stabilizer and N-(4-hydroxyphenyl)-p-toluenesulfonamide and 2-benzyloxynaphthalene, and preservability of image areas is further improved.

The amount of the image stabilizer in the heat-sensitive color-forming layer is preferably 10 is 100 parts by weight, more preferably 20 to 60 parts by weight, and even more preferably 30 to 60 parts by weight, with respect to 100 parts by weight of the electron-donating leuco dye in the layer, from the standpoint of effectively reducing background fogging and improving image preservability.

When 1,1,3-tris(2-methyl-4-hydroxy-5-tert-butylphenyl)butane ($\alpha$) and 1,1,3-tris(2-methyl-4-hydroxy-5-cyclohexylphenyl)butane ($\beta$) are combined, the ratio ($\alpha/\beta$) by weight is preferably 20/80 to 80/20, and more preferably 40/60 to 60/40.

When 1,1,3-tris(2-methyl-4-hydroxy-5-tert-butylphenyl)butane and/or 1,1,3-tris(2-methyl-4-hydroxy-5-cyclohexylphenyl)butane is combined with another image stabilizer, the amount of 1,1,3-tris(2-methyl-4-hydroxy-5-tert-butylphenyl)butane and/or 1,1,3-tris(2-methyl-4-hydroxy-5-cyclohexylphenyl)butane is preferably at least 50% by weight, and more preferably at least 70% by weight, of the total amount of the image stabilizer.

Examples of the UV absorbents include the following UV absorbents.

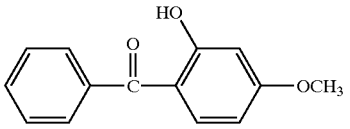

-continued

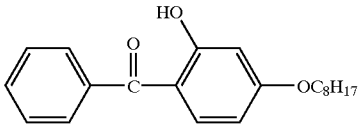

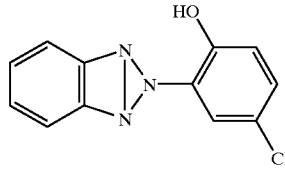

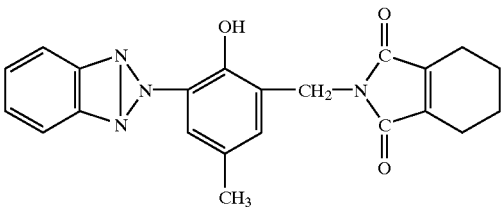

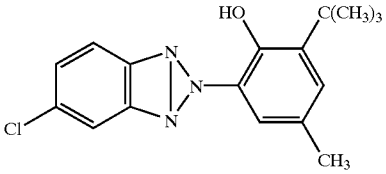

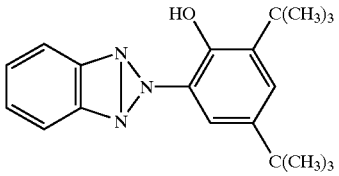

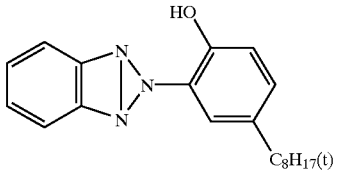

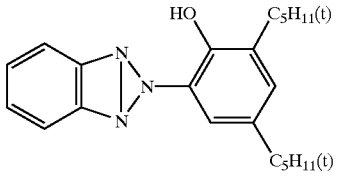

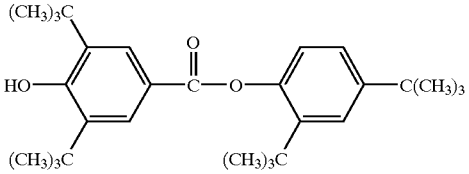

The heat-sensitive color-forming layer may also include a crosslinking agent to crosslink the PVA that serves as the adhesive. By the heat-sensitive color-forming layer including such a crosslinking agent, moisture resistance of the heat-sensitive recording material is improved.

As long as the crosslinking agent is capable of crosslinking the PVA, any crosslinking agent can be suitably used. However, aldehyde compounds such as glyoxal, and dihydrazide compounds such as adipic acid dihydrazide, are particularly preferable.

The amount of the crosslinking agent is preferably 1 to 50 parts by weight, and more preferably 3 to 20 parts by weight, with respect to 100 parts by weight of the polyvinyl alcohol to be crosslinked by the crosslinking agent and included in the heat-sensitive color-forming layer. It is preferable that the amount of the crosslinking agent is within the range of 1 to 50 parts by weight with respect to the PVA, in view of resistance to moisture.

In the present invention, the electron-donating leuco-dye and the electron-receiving compound can be dispersed in the adhesive or in a water-soluble binder. The water-soluble binder is preferably a compound in which at least 5% by weight is dissolved in water at 25° C.

Examples of the water-soluble binder include polyvinyl alcohol, methyl cellulose, carboxymethyl cellulose, starches (including modified starches), gelatin, arabic gum, casein, and saponified copolymers of styrene and maleic anhydride.

The binder may be used not only at the time of dispersion, but also for improving the film strength of the heat-sensitive color-forming layer. To this end, the water-soluble binder may be combined with a synthetic polymer latex binder such as styrene-butadiene copolymer, vinyl acetate copolymer, acrylonitrile-butadiene copolymer, methyl acrylate-butadiene copolymer or polyvinylidene chloride.

The electron-donating leuco-dye and electron-receiving compound may be dispersed together or separately by using a stirring grinder such as a ball mill, an attritor or a sand mill, to then be prepared as the coating liquid. The coating liquid may include metal soaps, waxes, surfactantes, antistatic agents, defoaming agents and fluorescent dyes as needed.

Metal salts of higher fatty acids, such as zinc stearate, calcium stearate and aluminium stearate, can be used as the metal soap.

Paraffin wax, microcrystalline wax, carnauba wax, methylolstearic acid amide, polyethylene wax, polystyrene wax and fatty acid amide-type wax can be used for the wax, either singly or in combination. For the surfactant, alkali metal salts and ammonium salts of alkylbenzenesulfonates, alkali metal salts of sulfosuccinic acids, and surfactants including fluorine can be used.

After these materials are mixed, they are applied to the support. There are no particular limitations on the method for coating. For example, the mixture can be applied with air-knife coaters, roll coaters, blade coaters or curtain coaters, dried, and then leveled with a calender. However, in the present invention, a method that utilizes a curtain coater is particularly preferable, because the heat-sensitive color-forming layer can be coated uniformly, and because sensitivity and image preservability are effectively improved.

There are no particular limitations on the amount of the heat-sensitive color-forming layer. Ordinarily, an amount in which the dry weight thereof is 2 and 7 g/m$^2$ is preferable.

If desired, a protective layer may be provided on the heat-sensitive color-forming layer. The protective layer may include organic fine powders, inorganic fine powders (inorganic pigments), binders, surfactants, and hot-melting substances. Examples of the inorganic pigment include calcium carbonate, silica, zinc oxide, titanium oxide, aluminium oxide, titanium dioxide, silicon dioxide, aluminium hydroxide, zinc hydroxide, barium sulfate, zinc sulfate, kaolin, clay, calcined clay, talc, colloidal silica, surface processed calcium and silica. For the organic fine powder, urea-formalin resin, copolymers of styrene and methacrylic acid, and polystyrene can be used.

Preferable examples of the inorganic pigment include aluminium hydroxide and kaolin. Aluminium hydroxide having a mean particle diameter of 0.5 to 0.9 $\mu$m is even more preferable, in view of color density when recording by a thermal head.

The amount of the inorganic pigment added is preferably 10 to 90% by weight, and more preferably 30 to 70% by weight, with respect to the solid content of the coating liquid for the protective layer.

The proportion at which the inorganic pigment and the water-soluble polymer are mixed varies depending on the type of inorganic pigment and the type of water-soluble polymer. However, the amount of the water-soluble polymer is preferably 50 to 400% by weight, and more preferably 100 to 250% by weight, with respect to the inorganic pigment.

The sum of the inorganic pigment and the water-soluble polymer binder in the protective layer is at least 50% by weight of the layer.

Examples of the binder in the protective layer include water-soluble polymers such as polyvinyl alcohol, modified polyvinyl alcohol (e.g., carboxy-modified polyvinyl alcohol, silicon-modified polyvinyl alcohol, acetoacetyl-modified polyvinyl alcohol, diacetone-modified polyvinyl alcohol, amide-modified polyvinyl alcohol, sulfo-modified polyvinyl alcohol), vinyl acetate-acrylamide copolymer, starch, oxidized starch, modified starch (e.g., urea phosphate-modified starch), methyl cellulose, carboxymethyl cellulose, hydroxymethyl cellulose, gelatins, arabic gum, casein, copolymers of styrene and maleic anhydride, alkyl esters of copolymers of styrene and maleic anhydride, hydrolyzed coploymers of styrene and maleic acid, polymers having carboxyl groups such as copolymers of styrene and acrylic acid, polyacrylamide derivatives, and polyvinyl pyrrolidone, as well as latexes such as styrene-butadiene rubber latex, acrylonitrile-butadiene rubber latex, methyl acrylate-butadiene rubber latex, and polyvinyl acetate emulsion. Among these, water-soluble polymers are preferable.

Among water-soluble polymers, polyvinyl alcohol, modified polyvinyl alcohol, oxidized starch, and urea phosphate-modified starch are preferable. It is even more preferable to mix polyvinyl alcohol and/or modified polyvinyl alcohol with oxidized starch and/or urea phosphate-modified starch in a ratio by weight of 90/10 to 10/90. When these three are combined, it is preferable to use the oxidized starch and urea phosphate-modified starch in a ratio of 10/90 to 90/10 by weight.

For the modified polyvinyl alcohol, acetoacetyl -modified polyvinyl alcohol, diacetone-modified polyvinyl alcohol, silicon-modified polyvinyl alcohol, and amide-modified polyvinyl alcohol are preferably used. In addition to these, sulfo-modified polyvinyl alcohol and carboxyl-modified polyvinyl alcohol can be used. When a crosslinking agent is combined to react with these polyvinyl alcohols, more preferable results are obtained.

The amount of the water-soluble polymer added is preferably 10 and 90% by weight, and more preferably 30 to 70% by weight, with respect to the solid content of the coating liquid for the protective layer.

A moisture resistance enhancer (crosslinking agent) can be added to crosslink the binder component in the protective layer and further improve the storage stability of the heat-sensitive recording material. Examples of the moisture resistance enhancer include: N-methylolurea, N-methylolmelamine, water-soluble precondensates such as urea-formalin; methylolated phenol; polyamine compounds such as ethylenediamine; polyaldehydes including dialdehyde compounds such as glyoxal, and glutaraldehyde; dihydrazide compounds such as adipic acid dihydrazide, and phthalic acid dihydrazide; polyfunctional epoxy compounds; polyvalent metal salts (with Al, Ti, Zr, Mg, etc.), inorganic crosslinking agents such as boric acid, borax, and colloidal silica; and polyamide-epichlorohydrin.

When the polyvinyl alcohol and/or modified polyvinyl alcohol are used, the ratio of the crosslinking agent to these polyvinyl alcohols is preferably 2 to 30% by weight, and more preferably 5 to 20% by weight. By using the crosslinking agent, film strength and moisture resistance are improved. Polyaldehyde compounds and dihydrazide compounds are preferable as the crosslinking agent in the present invention.

By adding a surfactant to the coating liquid for the protective layer, better inkjet ink compatibility and chemical resistance are obtained. Preferable examples of the surfactant include salts of alkylbenzenesulfonates such as sodium dodecylbenzenesulfonates; salts of alkylsulfosuccinates such as sodium dioctylsulfosuccinate, as well as polyoxyethylene alkyl ether phosphates, sodium hexametaphosphate, and salts of perfluoroalkylcarboxylic acids. Among these, salts of alkylsulfosuccinates are more preferable. The amount of the surfactant is preferably 0.1 to 5% by weight, and more preferably 0.5 to 3% by weight, with respect to the solid content of the coating liquid for the protective layer.

The coating liquid for the protective layer may further include lubricants, defoaming agents, fluorescent brighteners and chromatic organic pigments as long as the effects of the prevent invention are not compromised. Examples of the lubricant include metal soaps, such as zinc stearate and calcium stearate, and waxes, such as paraffin wax, microcrystalline wax, carnauba wax and synthetic polymer wax.

EXAMPLES

The present invention will now be specifically described with reference to the following Examples, which, however, are not intended to restrict the scope of the present invention. Unless otherwise indicated, "parts" and "%" in the following Examples are all by weight. Also, unless otherwise indicated, "mean particle size" means "volume-average particle size" measured with an LA-500 (manufactured by Horiba).

Example 1

Fabrication of Heat-sensitive Recording Material

Preparation of Coating Liquid for Heat-sensitive Color-forming Layer (Preparation of Dispersion A)

The following ingredients were dispersed in a ball mill to prepare a dispersion A having a mean particle size of 0.7 μm.

| [Composition of dispersion A] | |
|---|---|
| 2-Anilino-3-methyl-6-diethylaminofluoran (electron-donating leuco-dye) | 10 parts |
| 2.5% Solution of polyvinyl alcohol (Kuraray's PVA-105) | 50 parts |

(Preparation of Dispersion B)

The following ingredients were dispersed in a ball mill to prepare a dispersion B having a mean particle size of 0.7 μm.

| [Composition of dispersion B] | |
|---|---|
| N-(4-hydroxyphenyl)-p-toluenesulfonamide (electron-receiving compound) | 20 parts |
| 2.5% Solution of polyvinyl alcohol (Kuraray's PVA-105) | 100 parts |

(Preparation of Dispersion C)

The following ingredients were dispersed in a ball mill to prepare a dispersion C having a mean particle size of 0.7 μm.

| [Composition of dispersion C] | |
|---|---|
| 2-Benzyloxynaphthalene (sensitizer) | 20 parts |
| 2.5% Solution of polyvinyl alcohol (Kuraray's PVA-105) | 100 parts |

(Preparation of Pigment Dispersion D)

The following ingredients were dispersed in a sand mill to prepare a pigment dispersion D having a mean particle size of 2.0 μm.

| [Composition of pigment dispersion D] | |
|---|---|
| Calcite type precipitated calcium carbonate light | 40 parts |
| Sodium polyacrylate | 1 part |
| Distilled water | 60 parts |

The following compounds were mixed to prepare a coating liquid for a heat-sensitive color-forming layer.

| [Composition of coating liquid for heat-sensitive color-forming layer] | |
|---|---|
| Dispersion A | 60 parts |
| Dispersion B | 120 parts |
| Dispersion C | 120 parts |
| Pigment dispersion D | 101 parts |
| 30% Dispersion of zinc stearate | 15 parts |
| Paraffin wax (30%) | 15 parts |
| Sodium dodecylbenzenesulfonate (25%) | 4 parts |

Fabrication of Heat-sensitive Recording Material

Using a blade coater, a coating liquid for an undercoat layer was applied onto base paper having a Stoeckigt sizing degree of 5 seconds and a basic weight of 50 g/m$^2$ to form thereon an undercoat layer consisting essentially of pigment and binder and having a dry weight of 8 g/m$^2$. The base paper was thus coated with the undercoat layer. Next, using a curtain coater, the coating liquid for a heat-sensitive color-forming layer prepared in the above was applied onto the undercoat layer of the coated base paper to form thereon a heat-sensitive color-forming layer having a dry weight of 4 g/m$^2$. After dried, the heat-sensitive color-forming layer was then calendered. Thus was obtained a heat-sensitive recording material of Example 1.

Example 2

A heat-sensitive recording material of Example 2 was fabricated in the same manner as in Example 1, except that the amount of the dispersion C used was 90 parts and not 120 parts.

Example 3

A heat-sensitive recording material of Example 3 was fabricated in the same manner as in Example 1, except that the amount of the dispersion C used was 240 parts and not 120 parts.

Example 4

A heat-sensitive recording material of Example 4 was fabricated in the same manner as in Example 1, except that the dispersion A used included 2-anilino-3-methyl-6-(N-ethyl-N-isoamylamino)fluoran in place of 2-anilino-3-methyl-6-diethylaminofluoran.

Example 5

A heat-sensitive recording material of Example 5 was fabricated in the same manner as in Example 1, except that the dispersion A used included 2-anilino-3-methyl-6-(N-ethyl-N-isopropylamino)fluoran in place of 2-anilino-3-methyl-6-diethylaminofluoran.

Example 6

A heat-sensitive recording material of Example 6 was fabricated in the same manner as in Example 1, except that the amount of the dispersion C used was 60 parts and not 120 parts.

Example 7

A heat-sensitive recording material of Example 7 was fabricated in the same manner as in Example 1, except that the amount of the dispersion C used was 300 parts and not 120 parts.

Example 8

A heat-sensitive recording material of Example 8 was fabricated in the same manner as in Example 1, except that the dispersion A used included 2-anilino-3-methyl-6-dibutylaminofluoran in place of 2-anilino-3-methyl-6-diethylaminofluoran.

Example 9

A heat-sensitive recording material of Example 9 was fabricated in the same manner as in Example 1, except that the dispersion C used included stearic acid amide in place of 2-benzyloxynaphthalene.

Example 10

A heat-sensitive recording material of Example 10 was fabricated in the same manner as in Example 1, except that the dispersion C used included p-benzylbiphenyl in place of 2-benzyloxynaphthalene.

Example 11

Fabrication of Heat-sensitive Recording Material

Preparation of Coating Liquid for Heat-sensitive Color-forming Layer (Preparation of Dispersion A)

The following ingredients were dispersed in a sand mill to prepare a dispersion A having a mean particle size of 0.6 μm.

| [Composition of dispersion A] | |
|---|---|
| 2-Anilino-3-methyl-6-diethylaminofluoran (electron-donating leuco-dye) | 10 parts |
| 2.5% Solution of polyvinyl alcohol (Kuraray's PVA-105) | 50 parts |

(Preparation of Dispersion B)

The following ingredients were dispersed in a sand mill to prepare a dispersion B having a mean particle size of 0.6 μm.

| [Composition of dispersion B] | |
|---|---|
| N-(4-hydroxyphenyl)-p-toluenesulfonamide (electron-receiving compound) | 25 parts |
| 2.5% Solution of polyvinyl alcohol (Kuraray's PVA-105) | 100 parts |

(Preparation of Dispersion C)

The following ingredients were dispersed in a sand mill to prepare a dispersion C having a mean particle size of 0.6 μm.

| [Composition of dispersion C] | |
|---|---|
| 2-Benzyloxynaphthalene (sensitizer) | 25 parts |
| 2.5% Solution of polyvinyl alcohol (Kuraray's PVA-105) | 100 parts |

(Preparation of Dispersion D)

The following ingredients were dispersed in a sand mill to prepare a pigment dispersion D having a mean particle size of 1.2 μm.

| [Composition of pigment dispersion D] | |
|---|---|
| Calcite-type precipitated calcium carbonate light (Shiraishi Industry's Uniber 70) | 30 parts |
| Sodium hexametaphosphate | 0.3 part |
| Distilled water | 40 parts |

The following compounds were mixed to prepare a coating liquid for a heat-sensitive color-forming layer.

| [Composition of coating liquid for heat-sensitive color-forming layer] | |
|---|---|
| Dispersion A | 60 parts |
| Dispersion B | 125 parts |
| Dispersion C | 125 parts |
| Pigment dispersion D | 70 parts |
| 30% Dispersion of zinc stearate | 15 parts |
| Paraffin wax (30%) | 15 parts |
| Sodium dodecylbenzenesulfonate (25%) | 4 parts |

(Preparation of Coating Liquid for Undercoat Layer)

Using a dissolver, the following ingredients were stirred and mixed, to which were added 20 parts of SBR (styrene-butadiene latex) and 25 parts of oxidized starch (25%) to prepare a coating liquid for an undercoat layer.

| [Composition of coating liquid for undercoat layer] | |
|---|---|
| Calcined kaolin (having a degree of oil absorption of 75 ml/100 g) | 100 parts |
| Sodium hexametaphosphate | 1 part |
| Distilled water | 110 parts |

Fabrication of Heat-sensitive Recording Material

Using a blade coater, the coating liquid for an undercoat layer prepared in the above was applied onto woodfree base paper having a Stoeckigt sizing degree of 10 seconds and a basic weight of 50 g/m$^2$ to form thereon an undercoat layer having a dry weight of 8 g/m$^2$. After dried, the layer was then calendered. The base paper was thus coated with the undercoat layer. Next, using a curtain coater, the coating liquid for a heat-sensitive color-forming layer prepared in the above was applied onto the undercoat layer of the coated base paper to form thereon a heat-sensitive color-forming layer having a dry weight of 4 g/m$^2$. After dried, the heat-sensitive color-forming layer was then calendered. Thus was obtained a heat-sensitive recording material of Example 11.

Example 12

A heat-sensitive recording material of Example 12 was fabricated in the same manner as in Example 11, except that the pigment dispersion D used included calcite-type precipitated calcium carbonate light, Okutama Industry's Tamapear 121, in place of Uniber 70.

Example 13

A heat-sensitive recording material of Example 13 was fabricated in the same manner as in Example 11, except that the pigment dispersion D used included aluminium oxide, Showa Denko's Higilite H42, in place of calcite-type precipitated calcium carbonate light, Uniber 70.

Example 14

A heat-sensitive recording material of Example 14 was fabricated in the same manner as in Example 11, except that the amount of the pigment dispersion D used was 35 parts and not 70 parts.

Example 15

A heat-sensitive recording material of Example 15 was fabricated in the same manner as in Example 11, except that the amount of the pigment dispersion D used was 140 parts and not 70 parts.

Example 16

A heat-sensitive recording material of Example 16 was fabricated in the same manner as in Example 11, except that the amount of the pigment dispersion D used was 17.5 parts and not 70 parts.

Example 17

A heat-sensitive recording material of Example 17 was fabricated in the same manner as in Example 11, except that the amount of the pigment dispersion D used was 210 parts and not 70 parts.

Example 18

A heat-sensitive recording material of Example 18 was fabricated in the same manner as in Example 11, except that the mean particle size of the dispersion D used was 2.2 μm and not 1.2 μm.

Example 19

A heat-sensitive recording material of Example 19 was fabricated in the same manner as in Example 11, except that the mean particle size of the dispersion D used was 0.8 μm and not 1.2 μm.

Example 20

A heat-sensitive recording material of Example 20 was fabricated in the same manner as in Example 11, except that the mean particle size of the dispersion D used was 0.5 μm and not 1.2 μm.

Example 21

A heat-sensitive recording material of Example 21 was fabricated in the same manner as in Example 11, except that the mean particle size of the dispersion D used was 3.0 μm and not 1.2 μm.

Example 22

A heat-sensitive recording material of Example 22 was fabricated in the same manner as in Example 11, except that woodfree base paper to be the support was undercoated as follows: Using an air-knife coater and not a blade coater, a coating liquid for an undercoat layer mentioned below was applied onto woodfree base paper having a Stoeckigt sizing degree of 10 seconds and a basic weight of 50 g/m$^2$ to form thereon an undercoat layer having a dry weight of 8 g/m$^2$. After dried, the layer was then calendered. The thus-undercoated, woodfree base paper was used for the support.

(Preparation of Coating Liquid for Undercoat Layer)

Using a dissolver, the following ingredients were stirred and mixed, to which were added 20 parts of SBR (styrene-butadiene latex) and 25 parts of oxidized starch (25%) to prepare a coating liquid for an undercoat layer.

[Composition of Coating Liquid for Undercoat Layer]

| [Composition of coating liquid for undercoat layer] | |
|---|---|
| Calcined kaolin (having a degree of oil absorption of 75 ml/100 g) | 100 parts |
| Sodium hexametaphosphate | 1 part |
| Distilled water | 314 parts |

Example 23

A heat-sensitive recording material of Example 23 was fabricated in the same manner as in Example 11, except that the heat-sensitive color-forming layer was formed on the undercoat layer by the use of an air-knife coater and not a curtain coater.

Example 24

A heat-sensitive recording material of Example 24 was fabricated in the same manner as in Example 11, except that the pigment dispersion D used included kaolin, Shiraishi Industrial Calcium's Kaogloss, in place of calcite-type precipitated calcium carbonate light, Uniber 70.

Example 25

A heat-sensitive recording material of Example 25 was fabricated in the same manner as in Example 11, except that the pigment dispersion D used included aragonite-type calcium carbonate, Shiraishi Industry's Cal-light SA, in place of calcite-type precipitated calcium carbonate light, Uniber 70.

Comparative Example 1

A heat-sensitive recording material of Comparative Example 1 was fabricated in the same manner as in Example 11, except that the dispersion B used included 2,2-bis(4-hydroxyphenyl)propane (bisphenol A) in place of N-(4-hydroxyphenyl)-p-toluenesulfonamide.

Example 26

Fabrication of Heat-sensitive Recording Material

Preparation of Coating Liquid for Heat-sensitive Color-forming Layer (Preparation of Dispersion A)

The following ingredients were dispersed in a ball mill to prepare a dispersion A having a mean particle size of 0.6 $\mu$m.

| [Composition of dispersion A] | |
|---|---|
| 2-Anilino-3-methyl-6-diethylaminofluoran (electron-donating leuco-dye) | 10 parts |
| 2.5% Solution of polyvinyl alcohol (Kuraray's PVA-110, having a degree of saponification of 98.5 mol % and a degree of polymerization of 1000) | 50 parts |

(Preparation of Dispersion B)

The following ingredients were dispersed in a ball mill to prepare a dispersion B having a mean particle size of 0.6 $\mu$m.

| [Composition of dispersion B] | |
|---|---|
| N-(4-hydroxyphenyl)-p-toluenesulfonamide (electron-receiving compound) | 20 parts |
| 2.5% Solution of polyvinyl alcohol (Kuraray's PVA-110, having a degree of saponification of 98.5 mol % and a degree of polymerization of 1000) | 100 parts |

(Preparation of Dispersion C)

The following ingredients were dispersed in a ball mill to prepare a dispersion C having a mean particle size of 0.6 $\mu$m.

| [Composition of dispersion C] | |
|---|---|
| 2-Benzyloxynaphthalene (sensitizer) | 20 parts |
| 2.5% Solution of polyvinyl alcohol (Kuraray's PVA-110, having a degree of saponification of 98.5 mol % and a degree of polymerization of 1000) | 100 parts |

(Preparation of Pigment Dispersion D)

The following ingredients were dispersed in a sand mill to prepare a pigment dispersion D having a mean particle size of 2.0 $\mu$m.

| [Composition of pigment dispersion D] | |
|---|---|
| Precipitated calcium carbonate light | 40 parts |
| Sodium polyacrylate | 1 part |
| Water | 60 parts |

The following compounds were mixed to prepare a coating liquid for a heat-sensitive color-forming layer.

| [Composition of coating liquid for heat-sensitive color-forming layer] | |
|---|---|
| Dispersion A | 60 parts |
| Dispersion B | 120 parts |
| Dispersion C | 120 parts |
| Pigment dispersion D | 101 parts |
| 30% Dispersion of zinc stearate | 15 parts |
| Paraffin wax (30%) | 15 parts |
| Sodium dodecylbenzenesulfonate (25%) | 4 parts |

Fabrication of Heat-sensitive Recording Material

Using a blade coater, a coating liquid for an undercoat layer was applied onto base paper having a basic weight of 50 g/m$^2$ to form thereon an undercoat layer consisting essentially of calcined kaolin (having a degree of oil absorption of 78 ml/100 g), SBR and oxidized starch, and having a dry weight of 8 g/m$^2$. The base paper was thus coated with the undercoat layer. Next, using a curtain coater, the coating liquid for a heat-sensitive color-forming layer prepared in the above was applied onto the undercoat layer of the coated base paper to form thereon a heat-sensitive color-forming layer having a dry weight of 4 g/m$^2$. After dried, the heat-sensitive color-forming layer was then calendered. Thus was obtained a heat-sensitive recording material of Example 26.

Example 27

A heat-sensitive recording material of Example 27 was fabricated in the same manner as in Example 26, except that the coating liquid for the heat-sensitive color-forming layer additionally included 125 parts of a 8% solution of PVA-117 (from Kuraray, having a degree of saponification of 98.5 mol % and a degree of polymerization of 1750).

Example 28

A heat-sensitive recording material of Example 28 was fabricated in the same manner as in Example 27, except that the dispersions A, B and C used included Nippon Gosei Kagaku's Gohseran L-3266 (sulfo-modified polyvinyl alcohol, having a degree of saponification of 88 mol % and a degree of polymerization of 300) in place of PVA-110.

Example 29

A heat-sensitive recording material of Example 29 was fabricated in the same manner as in Example 27, except that the dispersions A, B and C used included Unitika's D-500 (diacetone-modified polyvinyl alcohol, having a degree of saponification of 98.5 mol % and a degree of polymerization of 500) in place of PVA-110.

Example 30

A heat-sensitive recording material of Example 30 was fabricated in the same manner as in Example 27, except that the dispersions A, B and C used included Nippon Gosei Kagaku's Gohsefimer Z200 (acetoacetyl-modified polyvinyl alcohol, having a degree of saponification of 98.5 mol % and a degree of polymerization of 1000) in place of PVA-110.

Example 31

A heat-sensitive recording material of Example 31 was fabricated in the same manner as in Example 28, except that an air-knife coater was used in forming the heat-sensitive color-forming layer.

Example 32

A heat-sensitive recording material of Example 32 was fabricated in the same manner as in Example 26, except that the dispersions A, B and C used included Kuraray's PVA-405 (polyvinyl alcohol, having a degree of saponification of 80 mol % and a degree of polymerization of 500) in place of PVA-110.

Example 33

A heat-sensitive recording material of Example 33 was fabricated in the same manner as in Example 26, except that the dispersions A, B and C used included Kuraray's PVA-417 (polyvinyl alcohol, having a degree of saponification of 80 mol % and a degree of polymerization of 1750) in place of PVA-110.

Comparative Example 2

A heat-sensitive recording material of Comparative Example 2 was fabricated in the same manner as in Example 26, except that the dispersion C used included 2,2-bis(4-hydroxyphenyl)propane (bisphenol A) in place of N-(4-hydroxyphenyl)-p-toluenesulfonamide.

Example 34

Preparation of Coating Liquid for Heat-sensitive Color-forming Layer

<Preparation of Liquid A (Electron-donating Leuco-dye)>

In a ball mill, the following ingredients were mixed to prepare a dispersion having a mean particle size of 0.8 μm.

| | |
|---|---|
| 3-Diethylamino-6-methyl-7-anilinofluoran | 10 parts |
| 2.5% Solution of polyvinyl alcohol (Kuraray's PVA-105, having a degree of saponification of 98.5 mol % and a degree of polymerization of 500) | 50 parts |

<Preparation of Liquid B (Electron-receiving Compound)>

In a ball mill, the following ingredients were mixed to prepare a dispersion having a mean particle size of 0.8 μm.

| | |
|---|---|
| N-(4-hydroxyphenyl)-p-toluenesulfonamide | 20 parts |
| 2.5% Solution of polyvinyl alcohol (PVA-105) | 100 parts |

<Preparation of Liquid C (Sensitizer)>

In a ball mill, the following ingredients were mixed to prepare a dispersion having a mean particle size of 0.8 μm.

| | |
|---|---|
| 2-Benzyloxynaphthalene | 20 parts |
| 2.5% Solution of polyvinyl alcohol (PVA-105) | 100 parts |

<Preparation of Liquid D (Pigment)>

In a sand mill, the following ingredients were mixed to prepare a pigment dispersion having a mean particle size of 2.0 μm.

| | |
|---|---|
| Calcium carbonate | 40 parts |
| Sodium polyacrylate | 1 part |
| Water | 60 parts |

60 parts of the liquid A, 120 parts of the liquid B, 120 parts of the liquid C, 101 parts of the liquid D, 15 parts of a 30% dispersion of zinc stearate, 15 parts of paraffin wax (30% dispersion), and 4 parts of sodium dodecylbenzenesulfonate (25%) were mixed to prepare a coating liquid for a heat-sensitive color-forming layer.

<Preparation of Coating Liquid for Protective Layer>

In a sand mill, the following ingredients were mixed to prepare a pigment dispersion having a mean particle size of 2 μm.

| | |
|---|---|
| Calcium carbonate | 40 parts |
| Sodium polyacrylate | 1 part |
| Water | 60 parts |

60 parts of water was added to 240 parts of a 25% aqueous solution of styrene-maleic anhydride copolymer alkyl ester (Arakawa Chemical's Polymalon 385), which was then mixed with the pigment dispersion prepared in the above. Then, this was further mixed with 25 parts of an emulsified dispersion of zinc stearate having a mean particle size of 0.15 μm (Chukyo Yushi's Hidorin F115), and 125 parts of a 2% aqueous solution of sodium salt of 2-ethylhexyl sulfosuccinate to prepare a coating liquid for a protective layer.

(Fabrication of Heat-sensitive Recording Material)

Using a curtain coater, the coating liquid for a heat-sensitive color-forming layer prepared in the above was applied onto woodfree paper having a basic weight of 50 g/m$^2$ and coated with an undercoat layer (10 g/m$^2$—this consists essentially of pigment and binder) to form thereon a heat-sensitive color-forming layer having a dry weight of 4 g/m$^2$. After thus coated, this was dried and calendered. Next, using a curtain coater, the coating liquid for a protective layer prepared in the above was applied onto the heat-sensitive color-forming layer to form thereon a protective layer having a dry weight of 2 g/m$^2$. After thus coated, this was dried and calendered, and a heat-sensitive recording material was thus obtained.

Example 35

A heat-sensitive recording material of Example 35 was fabricated in the same manner as in Example 34, except that the protective layer included aluminium hydroxide having a mean particle size of 1 $\mu$m (Showa Denko's Higilite H42) in place of calcium carbonate.

Example 36

A heat-sensitive recording material of Example 36 was fabricated in the same manner as in Example 34, except that the protective layer included kaolin (Shiraishi Kogyo's Kaobright) in place of calcium carbonate.

Example 37

A heat-sensitive recording material of Example 37 was fabricated in the same manner as in Example 35, except that 400 parts of a 15% aqueous solution of polyvinyl alcohol (Kuraray's PVA105) was used in place of 240 parts of the 25% aqueous solution of styrene-maleic anhydride copolymer alkyl ester (Arakawa Chemical's Polymalon 385) used in Example 35.

Example 38

A heat-sensitive recording material of Example 38 was fabricated in the same manner as in Example 35, except that 400 parts of a 15% aqueous solution of oxidized starch (Nippon Shokuhin Kako's MS3800) was used in place of 240 parts of the 25% aqueous solution of styrene-maleic anhydride copolymer alkyl ester (Arakawa Chemical's Polymalon 385) used in Example 35.

Example 39

A heat-sensitive recording material of Example 39 was fabricated in the same manner as in Example 35, except that 400 parts of a 15% aqueous solution of urea phosphate-modified starch (Nippon Shokuhin Kako's MS4600) was used in place of 240 parts of the 25% aqueous solution of styrene-maleic anhydride copolymer alkyl ester (Arakawa Chemical's Polymalon 385) used in Example 35.

Example 40

A heat-sensitive recording material of Example 40 was fabricated in the same manner as in Example 35, except that 200 parts of a 15% aqueous solution of oxidized starch (Nippon Shokuhin Kako's MS3800) and 200 parts of a 15% aqueous solution of polyvinyl alcohol (Kuraray's PVA105) were used in place of 240 parts of the 25% aqueous solution of styrene-maleic anhydride copolymer alkyl ester (Arakawa Chemical's Polymalon 385) used in Example 35.

Example 41

A heat-sensitive recording material of Example 41 was fabricated in the same manner as in Example 35, except that 200 parts of a 15% aqueous solution of urea phosphate-modified starch (Nippon Shokuhin Kako's MS4600) and 200 parts of a 15% aqueous solution of polyvinyl alcohol (Kuraray's PVA105) were used in place of 240 parts of the 25% aqueous solution of styrene-maleic anhydride copolymer alkyl ester (Arakawa Chemical's Polymalon 385) used in Example 35.

Example 42

A heat-sensitive recording material of Example 42 was fabricated in the same manner as in Example 40, except that aluminium hydroxide having a mean particle size of 0.6 $\mu$m (Sumitomo Chemical's C-3005) was used in place of aluminium hydroxide having a mean particle size of 1 $\mu$m used in Example 40.

Example 43

A heat-sensitive recording material of Example 43 was fabricated in the same manner as in Example 42, except that 400 parts of a 7.5% aqueous solution of silicon-modified polyvinyl alcohol (Kuraray's R-1130) was used in place of 240 parts of the 15% aqueous solution of polyvinyl alcohol (Kuraray's PVA105) used in Example 42.

Example 44

A heat-sensitive recording material of Example 44 was fabricated in the same manner as in Example 42, except that 400 parts of a 7.5% aqueous solution of diacetone-modified polyvinyl alcohol (Unitika's D-700) was used in place of 200 parts of the 15% aqueous solution of polyvinyl alcohol (Kuraray's PVA105) used in Example 42, and 30 parts of a 5% aqueous solution of adipic acid dihydrazide was added thereto.

Example 45

A heat-sensitive recording material of Example 45 was fabricated in the same manner as in Example 42, except that 400 parts of a 7.5% aqueous solution of acetoacetyl-modified polyvinyl alcohol (Nippon Gosei Kagaku's Gohsefimer Z-200) was used in place of 200 parts of the 15% aqueous solution of polyvinyl alcohol (Kuraray's PVA105) used in Example 42, and 30 parts of a 10% aqueous solution of glyoxal was added thereto.

Example 46

A heat-sensitive recording material of Example 46 was fabricated in the same manner as in Example 42, except that 400 parts of a 7.5% aqueous solution of amide-modified polyvinyl alcohol (Nippon Gosei Kagaku's NP20H) was used in place of 200 parts of the 15% aqueous solution of polyvinyl alcohol (Kuraray's PVA105) used in Example 42, and 30 parts of a 10% aqueous solution of glyoxal was added thereto.

Example 47

A heat-sensitive recording material of Example 47 was fabricated in the same manner as in Example 43, except that an air-knife coater was used in forming the heat-sensitive color-forming layer.

Comparative Example 3

A heat-sensitive recording material of Comparative Example 3 was fabricated in the same manner as in Example 34, except that bisphenol A was used in place of N-(4-hydroxyphenyl)-p-toluenesulfonamide in preparing the liquid B.

Example 48

A heat-sensitive recording material of Example 48 was fabricated in the same manner as in Example 34, except that the protective layer was not provided.

Example 49

Preparation of Coating Liquid for Heat-sensitive Color-forming Layer

<Preparation of Liquid A (Electron-donating Leuco-dye)>

In a ball mill, the following ingredients were mixed to prepare a dispersion having a mean particle size of 0.8 μm.

| | |
|---|---|
| 3-Diethylamino-6-methyl-7-anilinofluoran | 10 parts |
| 2.5% Solution of polyvinyl alcohol (Kuraray's PVA-105, having a degree of saponification of 98.5 mol % and a degree of polymerization of 500) | 50 parts |

<Preparation of Liquid B (Electron-receiving Compound)>

In a ball mill, the following ingredients were mixed to prepare a dispersion having a mean particle size of 0.8 μm.

| | |
|---|---|
| N-(4-hydroxyphenyl)-p-toluenesulfonamide | 20 parts |
| 2.5% Solution of polyvinyl alcohol (PVA-105) | 100 parts |

<Preparation of Liquid C (Sensitizer)>

In a ball mill, the following ingredients were mixed to prepare a dispersion having a mean particle size of 0.8 μm.

| | |
|---|---|
| 2-Benzyloxynaphthalene | 20 parts |
| 2.5% Solution of polyvinyl alcohol (PVA-105) | 100 parts |

<Preparation of Liquid D (Pigment)>

In a sand mill, the following ingredients were mixed to prepare a pigment dispersion having a mean particle size of 2.0 μm.

| | |
|---|---|
| Amorphous silica (Mizusawa Chemical's Mizukasil P-832) | 20 parts |
| Sodium polyacrylate | 1 part |
| Water | 80 parts |

60 parts of the liquid A, 120 parts of the liquid B. 120 parts of the liquid C, 101 parts of the liquid D, 15 parts of a 30% dispersion of zinc stearate, 15 parts of paraffin wax (30%), and 4 parts of sodium dodecylbenzenesulfonate (25%) were mixed to prepare a coating liquid for a heat-sensitive color-forming layer.

(Fabrication of Heat-sensitive Recording Material)

Using a curtain coater, the coating liquid for a heat-sensitive color-forming layer prepared in the above was applied onto base paper that had been prepared by coating recycled paper (50 g/m$^2$—this is composed of 70% of waste pulp and 30% of LBKP, and has a surface smoothness measured according to JIS-P8119 of 170 seconds) with an undercoat layer (10 g/m$^2$—this consists essentially of pigment and binder), to thereby form thereon a heat-sensitive color-forming layer having a dry weight of 4 g/m$^2$. After thus coated, this was dried and calendered. Thus was obtained a heat-sensitive recording material.

Example 50

A heat-sensitive recording material of Example 50 was fabricated in the same manner as in Example 49, except that 40 parts of cubic-system calcium carbonate (Shiraishi Kogyo's Brilliant 15) was used in preparing the liquid D, in place of amorphous silica used in Example 49.

Example 51

A heat-sensitive recording material of Example 51 was fabricated in the same manner as in Example 49, except that 40 parts of aluminium hydroxide (Showa Denko's Higilite H42, having a mean particle size of 1.0μ) was used in preparing the liquid D, in place of amorphous silica used in Example 49.

Example 52

A heat-sensitive recording material of Example 52 was fabricated in the same manner as in Example 49, except that 40 parts of aluminium hydroxide (Sumitomo Chemical's C-3005, having a mean particle size of 0.6 μm) was used in preparing the liquid D, in place of amorphous silica used in Example 49.

Example 53

A heat-sensitive recording material of Example 53 was fabricated in the same manner as in Example 49, except that 40 parts of burr-like calcium carbonate (Shiraishi Kogyo's Uniber 70, having a mean particle size of 1.5 μm) was used in preparing the liquid D, in place of amorphous silica used in Example 49.

Example 54

A heat-sensitive recording material of Example 54 was fabricated in the same manner as in Example 49, except that 30 parts of aluminium hydroxide (Sumitomo Chemical's C-3005, having a mean particle size of 0.6 μm) and 10 parts of basic magnesium carbonate (Kamishima Chemical's Kinsei, having a mean particle size of 0.6 μm) were used in place of amorphous silica.

Example 55

A heat-sensitive recording material of Example 55 was fabricated in the same manner as in Example 49, except that 30 parts of aluminium hydroxide (Sumitomo Chemical's C-3005, having a mean particle size of 0.6 μm) and 10 parts of magnesium oxide (Kamishima Chemical's Starmag M, having a mean particle size of 0.5 μm) were used in place of amorphous silica.

Example 56

A heat-sensitive recording material of Example 56 was fabricated in the same manner as in Example 53, except that an air-knife coater was used in forming the heat-sensitive color-forming layer.

Comparative Example 4

A heat-sensitive recording material of Comparative Example 4 was fabricated in the same manner as in Example 49, except that bisphenol A was used in preparing the liquid B, in place of N-(4-hydroxyphenyl)-p-toluenesulfonamide used in Example 49.

Example 57

A heat-sensitive recording material of Example 57 was fabricated in the same manner as in Example 49, except that woodfree paper composed of 50% NBKP and 50% LBKP and having a degree of surface smoothness measured according to JIS-P8119 of 170 seconds was used in place of the recycled paper used in Example 49.

Comparative Example 5

A heat-sensitive recording material of Comparative Example 5 was fabricated in the same manner as in Comparative Example 4, except that woodfree paper composed of 50% NBKP and 50% LBKP and having a degree of surface smoothness measured according to JIS-P8119 of 170 seconds was used in place of the recycled paper used in Comparative Example 4.

Example 58

Fabrication of Heat-sensitive Recording Material

<Preparation of Coating Liquid for Heat-sensitive Color-forming Layer>

(Preparation of Dispersion A)

The following ingredients were dispersed in a sand mill to prepare a dispersion A having a mean particle size of 0.7 μm.

| [Composition of dispersion A] | |
|---|---|
| 2-Anilino-3-methyl-6-diethylaminofluoran (electron-donating leuco-dye) | 10 parts |
| 2.5% Solution of polyvinyl alcohol (Kuraray's PVA-105) | 50 parts |

(Preparation of Dispersion B)

The following ingredients were dispersed in a sand mill to prepare a dispersion B having a mean particle size of 0.7 μm.

[Composition of Dispersion B]

| [Composition of dispersion B] | |
|---|---|
| N-(4-hydroxyphenyl)-p-toluenesulfonamide (electron-receiving compound) | 20 parts |
| 2.5% Solution of polyvinyl alcohol (Kuraray's PVA-105) | 100 parts |

(Preparation of Dispersion C)

The following ingredients were dispersed in a sand mill to prepare a dispersion C having a mean particle size of 0.7 μm.

| [Composition of dispersion C] | |
|---|---|
| 2-Benzyloxynaphthalene (sensitizer) | 20 parts |
| 2.5% Solution of polyvinyl alcohol (Kuraray's PVA-105) | 100 parts |

(Preparation of Dispersion D)

The following ingredients were dispersed in a sand mill to prepare a dispersion D having a mean particle size of 0.7 μm.

| [Composition of dispersion D] | |
|---|---|
| Methylolstearic acid amide (sensitizer) | 10 parts |
| 2.5% Solution of polyvinyl alcohol (Kuraray's PVA-105) | 40 parts |

(Preparation of Dispersion E)

The following ingredients were dispersed in a sand mill to prepare a dispersion E having a mean particle size of 0.7 μm.

| [Composition of dispersion E] | |
|---|---|
| 1,1,3-Tris(2-methyl-4-hydroxy-5-tert-butylphenyl)butane (image stabilizer) | 5 parts |
| 2.5% Solution of polyvinyl alcohol (Kuraray's PVA-105) | 25 parts |

(Preparation of Pigment Dispersion F)

The following ingredients were dispersed in a sand mill to prepare a pigment dispersion F having a mean particle size of 2.0 μm.

| [Composition of pigment dispersion F] | |
|---|---|
| Calcite type precipitated calcium carbonate light | 40 parts |
| Sodium polyacrylate | 1 part |
| Water | 60 parts |

The following compounds were mixed to prepare a coating liquid for a heat-sensitive color-forming layer.

| [Composition of coating liquid for heat-sensitive color-forming layer] | |
|---|---|
| Dispersion A | 60 parts |
| Dispersion B | 120 parts |
| Dispersion C | 120 parts |
| Dispersion D | 50 parts |
| Dispersion E | 30 parts |
| Pigment dispersion F | 101 parts |
| 30% Dispersion of zinc stearate | 15 parts |
| Paraffin wax (30%) | 15 parts |
| Sodium dodecylbenzenesulfonate (25%) | 4 parts |

(Preparation of Coating Liquid for Undercoat Layer)

Using a dissolver, the following ingredients were stirred and mixed, to which were added 20 parts of SBR and 25 parts of oxidized starch (25%) to prepare a coating liquid for an undercoat layer.

| [Composition of coating liquid for undercoat layer] | |
|---|---|
| Calcined kaolin (having a degree of oil absorption of 75 ml/100 g) | 100 parts |
| Sodium hexametaphosphate | 1 part |
| Distilled water | 110 parts |

<Fabrication of Heat-sensitive Recording Material>

Using a blade coater, the coating liquid for an undercoat layer prepared in the above was applied onto base paper having a basic weight of 50 g/m$^2$ to form thereon an undercoat layer having a dry weight of 8 g/m$^2$. After dried, the base paper was thus coated with the undercoat layer. Next, using a curtain coater, the coating liquid for a heat-sensitive color-forming layer prepared in the above was applied onto the undercoat layer of the coated base paper to form thereon a heat-sensitive color-forming layer having a dry weight of 4.5 g/m$^2$. After dried, the heat-sensitive color-forming layer was then calendered. Thus was obtained a heat-sensitive recording material of Example 58.

Example 59

A heat-sensitive recording material of Example 59 was fabricated in the same manner as in Example 58, except that the amount of the dispersion C used was 150 parts and not 120 parts, and the amount of the dispersion D used was 25 parts and not 50 parts.

Example 60

A heat-sensitive recording material of Example 60 was fabricated in the same manner as in Example 58, except that the amount of the dispersion C used was 165 parts and not 120 parts, and the amount of the dispersion D used was 12.5 parts and not 50 parts.

Example 61

A heat-sensitive recording material of Example 61 was fabricated in the same manner as in Example 58, except that the amount of the dispersion C used was 75 parts and not 120 parts, and the amount of the dispersion D used was 87.5 parts and not 50 parts.

Example 62

A heat-sensitive recording material of Example 62 was fabricated in the same manner as in Example 58, except that the dispersion E used included 1,1,3-tris(2-methyl-4-hydroxy-5-cyclohexylphenyl)butane in place of 1,1,3-tris(2-methyl-4-hydroxy-5-tert-butylphenyl)butane.

Example 63

A heat-sensitive recording material of Example 63 was fabricated in the same manner as in Example 58, except that the amount of the dispersion E used was 10 parts and not 30 parts.

Example 64

A heat-sensitive recording material of Example 64 was fabricated in the same manner as in Example 58, except that the amount of the dispersion E used was 50 parts and not 30 parts.

Example 65

A heat-sensitive recording material of Example 65 was fabricated in the same manner as in Example 58, except that the amount of the dispersion E used was 3 parts and not 30 parts.

Example 66

A heat-sensitive recording material of Example 66 was fabricated in the same manner as in Example 58, except that an air-knife coater and not a curtain coater was used in forming the heat-sensitive color-forming layer.

Example 67

A heat-sensitive recording material of Example 67 was fabricated in the same manner as in Example 63, except that a protective layer was provided. Precisely, using a curtain coater, a coating liquid for a protective layer mentioned below was applied onto the heat-sensitive color-forming layer before the heat-sensitive color-forming layer was calendered, and then dried to thereby form thereon a protective layer having a dry weight of 2 g/m$^2$. After thus coated, the protective layer was then calendered.

<Preparation of Coating Liquid for Protective Layer>

First, in a sand mill, the compounds mentioned below were dispersed to prepare a pigment dispersion having a mean particle size of 2 $\mu$m. On the other hand, 60 parts of water was added to 200 parts of a 15% aqueous solution of urea phosphate-modified starch (Nippon Shokuhin Kako's MS4600) and 200 parts of a 15% aqueous solution of polyvinyl alcohol (Kuraray's PVA-105), which was then mixed with the pigment dispersion prepared in the above. Then, this was further mixed with 25 parts of an emulsified dispersion of zinc stearate having a mean particle size of 0.15 $\mu$m (Chukyo Yushi's Hidorin F115), and 125 parts of a 2% aqueous solution of sodium salt of 2-ethylhexyl sulfosuccinate to prepare a coating liquid for a protective layer.

| [Composition of coating liquid for protective layer] | |
|---|---|
| Aluminium hydroxide (Showa Denko's Higilite H42, having a mean particle size of 1 $\mu$m) | 40 parts |
| Sodium polyacrylate | 1 part |
| Water | 60 parts |

Example 68

A heat-sensitive recording material of Example 68 was fabricated in the same manner as in Example 58, except that the dispersion C was not used and the amount of the dispersion D used was 60 parts and not 50 parts.

Example 69

A heat-sensitive recording material of Example 69 was fabricated in the same manner as in Example 58, except that the amount of the dispersion C used was 36 parts and not 120 parts and the amount of the dispersion D used was 120 parts and not 50 parts.

Example 70

A heat-sensitive recording material of Example 70 was fabricated in the same manner as in Example 58, except that the dispersion E was not used.

Comparative Example 6

A heat-sensitive recording material of Comparative Example 6 was fabricated in the same manner as in Example 58, except that the dispersion B used included 2,2-bis(4-hydroxyphenyl)propane (bisphenol A) in place of N-(4-hydroxyphenyl)-p-toluenesulfonamide.

Example 71

A heat-sensitive recording material of Example 71 was fabricated in the same manner as in Example 58, except that the dispersion E used included 2,2'-methylenebis(4-methyl-6-tert-butylphenol) in place of 1,1,3-tris(2-methyl-4-hydroxy-5-tert-butylphenyl)butane.

Example 72

A heat-sensitive recording material of Example 72 was fabricated in the same manner as in Example 58, except that the dispersion D was not used and the amount of the dispersion C used was 170 parts and not 120 parts.

Evaluation

The heat-sensitive recording materials of Examples 1 to 10 were tested for sensitivity, background fogging, image preservability and chemical resistance, and the test results are shown in Table 1. The heat-sensitive recording materials of Examples 11 to 25 and Comparative Example 1 were tested for sensitivity, background fogging, image preservability, chemical resistance, contaminant deposition on thermal heads and abrasion of thermal heads, and the test results are shown in Table 2. The heat-sensitive recording materials of Examples 26 to 33 and Comparative Example 2 were tested for sensitivity, background fogging, image preservability and printability, and the test results are shown in Table 3. The heat-sensitive recording materials of Examples 34 to 48 and Comparative Example 3 were tested for sensitivity, background fogging, image preservability and inkjet ink resistance, and the test results are shown in Table 4. The heat-sensitive recording materials of Examples 49 to 57 and Comparative Examples 4 and 5 were tested for sensitivity, background fogging and image preservability, and the test results are shown in Table 5. The heat-sensitive recording materials of Examples 58 to 72 and Comparative Example 6 were tested for sensitivity, background fogging, image preservability, chemical resistance and sticking resistance, and the test results are shown in Table 6.

The test methods are described below.

(1) Sensitivity:

Using a printer equipped with a thermal head (Kyosera's KJT-216-8MPD1) and a pressure roll which was disposed just before the thermal head and applied a pressure of 100 kg/cm$^2$ to the materials, the heat-sensitive recording materials were printed. The head voltage was 24 V; the pulse repetition period was 10 ms; and each sample to be printed was pressed against the pressure roll. The print density was measured with a Macbeth reflection densitometer, RD-918. The pulse width was 2.1 ms for Examples 1 to 10 and 26 to 72 and Comparative Examples 2 to 6, and was 1.8 ms for Examples 11 to 25 and Comparative Example 1.

(2) Background Fogging:

The heat-sensitive recording materials of Examples 1 to 25 and 34 to 72, and Comparative Examples 1 and 3 to 6 were left at 60° C. and 20% RH for 24 hours; and those of Examples 26 to 33 and Comparative Example 2 were at 60° C. and 30% RH for 24 hours. After having been thus left, the density of the background was measured with a Macbeth reflection densitometer, RD-918. The samples having a lower value are better.

(3) Image Preservability:

Using the same device under the same condition as in the above (1), the heat-sensitive recording materials were printed to record images thereon. After having been thus printed, those of Examples 1 to 25 and 34 to 72, and Comparative Examples 1 and 3 to 6 were left at 60° C. and 20% RH for 24 hours, while those of Examples 26 to 33 and Comparative Example 2 were at 60° C. and 30% RH for 24 hours. Then, their image density was measured with a Macbeth reflection densitometer, RD-918. On the other hand, the heat-sensitive recording materials were also printed to record images thereon, using the same device under the same condition as in the above (1), and their image density was immediately measured without being aged. From the data, the image density retentiveness of the aged samples was obtained according to the following equation. The samples having a higher value of image density retentiveness have better image preservability.

Image preservability (%)=(image density after aged/image density not aged)×100.

(4) Chemical Resistance:

Using a fluorescent ink pen (Zebra 2-Pink Fluorescent Pen from Zebra), an image was written on the surface of each heat-sensitive recording material. After left for 1 day, the materials were visually checked as to whether or not the background area was fogged and the image was kept stable, and were evaluated according to the following criteria.

[Criteria for Evaluation]

○: No fogging was present, and the image did not change.

Δ: Some fogging was present, and the image changed somewhat thin.

x: A lot of fogging were present, and the image almost disappeared.

(5) Contaminant Deposition on Thermal Head:

A roll of the heat-sensitive recording material to be tested was set in a facsimile (Sanyo Electric's SFX85). Using a No. 3 Chart by the Electronic Image Society of Japan as a test chart, an image was printed on the roll of about 100 m. Thereafter, the thermal head was checked for contaminant deposition thereon. The materials thus tested were evaluated according to the following criteria.

[Criteria for Evaluation]

○: Little contaminant deposition was found on the thermal head, and no void defects were seen in the prints.

Δ: Some contaminant deposition was found on the thermal head, but no void defects were seen in the prints.

x: Much contaminant deposition was found on the thermal head, and some void defects were seen in the prints.

(6) Abrasion of Thermal Head:

A4-size sheets of the heat-sensitive recording material to be tested were set in a word processor (Toshiba's Rupo JV), and using a test chart having an image in 20% of the test chart, the image was printed on 1000 sheets of the material. After this, the serial thermal head was checked for the level of abrasion. The materials thus tested were evaluated according to the following criteria.

[Criteria for Evaluation]

○: The thermal head abraded little, and no void defects were seen in the prints.

Δ: The thermal head abraded a little, but no void defects were seen in the prints.

x: The thermal head much abraded, and some void defects were seen in the prints.

(7) Printability (Print Strength):

Using an RI tester (Akari Seisakusho's RI-3 Model), 1 g of ink (Toka's SMX Tackgreat Ink 15) was transferred onto each heat-sensitive recording material. With that, the ink-transferred surface of the material was visually checked for surface delamination. The materials thus tested were evaluated according to the following criteria.

[Criteria for Evaluation]

○○: No surface delamination was found on the ink-transferred surface.

○: Some surface delamination was found on the ink-transferred surface, but the surface condition was good.

x: The ink-transferred surface was delaminated, and the materials are unacceptable for practical use.

(8) Inkjet Ink Resistance:

Using an inkjet printer (Epson MJ930C), an image was printed on printing paper in a mode of high-quality printing. On the other hand, the heat-sensitive recording material to be tested was printed thereon in the same manner as in the test <1> for sensitivity. The image-printed surface of the former was kept in contact with that of the latter, at 25° C. for 48 hours. After this, the image density of the heat-sensitive recording material was measured with Macbeth RD918. In addition, the image density of the heat-sensitive recording material not kept in contact with the inkjet printed paper was also measured. From the data, obtained was the ratio of the image density of the sample kept in contact with the inkjet printed paper to that of the sample not kept in contact with it. This indicates the image density retentiveness of the sample kept in contact with the inkjet printed paper. The samples having a larger value of the ratio have better retention of inkjet ink.

(9) Sticking Resistance:

The heat-sensitive recording material to be tested was set in a facsimile (Sanyo Electric's SFX85), and using a test chart, No. 3 Chart by the Electronic Image Society of Japan, an image was printed thereon. While driven, the facsimile was checked for noises. The prints were visually checked for void defects. Based on these, the materials tested were evaluated according to the following criteria.

[Criteria for Evaluation]

○: There was no noise except the printing beat, and no void defects were seen in the prints.

Δ: There was some noise, and some void defects were seen in the prints.

x: There was much noise (as the material stuck to the head) and many void defects were seen in the prints.

TABLE 1

| | Sensitivity | Background Fogging | Image Preservability | Chemical Resistance |
|---|---|---|---|---|
| Example 1 | 1.33 | 0.08 | 85% | ○ |
| Example 2 | 1.30 | 0.08 | 83% | ○ |
| Example 3 | 1.31 | 0.09 | 79% | ○ |
| Example 4 | 1.30 | 0.09 | 82% | ○ |
| Example 5 | 1.30 | 0.07 | 78% | ○ |
| Example 6 | 1.25 | 0.10 | 65% | ○ |
| Example 7 | 1.26 | 0.08 | 78% | ○ |
| Example 8 | 1.30 | 0.08 | 40% | Δ |
| Example 9 | 1.24 | 0.13 | 32% | Δ |
| Example 10 | 1.25 | 0.14 | 58% | ○ |

From Table 1, it is understood that the heat-sensitive recording materials of Examples 1 to 8 of the invention all have high sensitivity, good background fogging resistance, good color image preservability and good chemical resistance. When the data in Examples 1 to 5 are compared with those in Examples 6 and 7, it is understood that the heat-sensitive recording materials in which the ratio by weight, i/p×100, of the sensitizer (i) to the electron-receiving compound (p) falls between 75 and 200% have better image preservability. When the data in Examples 1 to 5 are compare with those in Example 8, it is understood that the heat-sensitive recording materials including, as the electron-donating leuco-dye, any of 2-anilino-3-methyl-6-diethylaminofluoran, 2-anilino-3-methyl-6-(N-ethyl-N-isoamylamino)fluoran or 2-anilino-3-methyl-6-(N-ethyl-N-propylamino)fluoran have better image preservability and better chemical resistance.

From Table 1, it is understood that none of the sensitivity, the background fogging resistance, the image preservability and the chemical resistance of the heat-sensitive recording material of Example 9 which includes, as the sensitizer, stearic acid amide was satisfactory. It is also understood that the sensitivity of the heat-sensitive recording material of Example 10 which includes, as the sensitizer, p-benzylbiphenyl is also not good.

TABLE 2

| | Sensitivity | Background Fogging | Image preserv-ability | Chemical Resistance | Contaminant Deposition on Head | Abrasion of Head |
|---|---|---|---|---|---|---|
| Example 11 | 1.30 | 0.08 | 85 | ○ | ○ | ○ |
| Example 12 | 1.29 | 0.08 | 83 | ○ | ○ | ○ |
| Example 13 | 1.31 | 0.09 | 80 | ○ | ○ | ○ |
| Example 14 | 1.31 | 0.08 | 84 | ○ | ○ | ○ |
| Example 15 | 1.28 | 0.07 | 79 | ○ | ○ | ○ |
| Example 16 | 1.30 | 0.10 | 80 | ○ | Δ | ○ |
| Example 17 | 1.27 | 0.08 | 76 | ○ | ○ | ○ |
| Example 18 | 1.28 | 0.08 | 80 | ○ | ○ | ○ |
| Example 19 | 1.30 | 0.08 | 81 | ○ | Δ | ○ |
| Example 20 | 1.30 | 0.10 | 78 | ○ | Δ | ○ |
| Example 21 | 1.27 | 0.08 | 75 | ○ | ○ | ○ |
| Example 22 | 1.26 | 0.08 | 65 | ○ | ○ | ○ |
| Example 23 | 1.27 | 0.09 | 76 | ○ | Δ | ○ |
| Example 24 | 1.23 | 0.10 | 74 | ○ | Δ | X |
| Example 25 | 1.22 | 0.10 | 76 | ○ | X | ○ |
| Comparative Example 1 | 1.30 | 0.08 | 43 | X | ○ | ○ |

From Table 2, it is understood that the heat-sensitive recording materials of Examples 11 to 23 all have high sensitivity, good background fogging resistance, good image preservability and good chemical resistance, and they leave little contaminants on heads and do not abrade heads. In particular, those in which the amount of the inorganic pigment falls between 50 and 250% of the electron-receiving compound therein are better than the others. When Example 11 is compared with Example 22, it is understood that the undercoat layer formed by the use of a blade coater enhances the image preservability of the recording material.

The heat-sensitive recording materials of Examples 24 and 25 and Comparative Example 1 are inferior to those of Examples 11 to 23 in point of some of their properties. In particular, the image preservability of the material including, as the electron-receiving compound, bisphenol A is extremely poor.

TABLE 3

| | Sensitivity | Background Fogging | Image Preservability | Printability |
|---|---|---|---|---|
| Example 26 | 1.28 | 0.08 | 80 | ○ |
| Example 27 | 1.25 | 0.07 | 85 | ○○ |
| Example 28 | 1.28 | 0.08 | 83 | ○○ |
| Example 29 | 1.27 | 0.07 | 84 | ○○ |
| Example 30 | 1.26 | 0.08 | 83 | ○○ |
| Example 31 | 1.25 | 0.08 | 81 | ○○ |
| Example 32 | 1.25 | 0.12 | 75 | X |
| Example 33 | 1.19 | 0.11 | 77 | ○ |
| Comparative Example 2 | 1.33 | 0.10 | 50 | ○ |

From Table 3, it is understood that the heat-sensitive recording materials, in which N-(4-hydroxyphenyl)-p-toluenesulfonamide was used as the electron-receiving compound and in which the degree of saponification and the degree of polymerization of the adhesive were within the range of the present invention, all have high sensitivity, good background fogging resistance, good image preservability and good printability. In particular, those of Examples 27 to 30 which include PVA having a high degree of polymerization have especially good printability.

However, the heat-sensitive recording materials of Examples 32 and 33 which include PVA having a degree of saponification of smaller than 85 mol % are not so good in point of the sensitivity and the printability. The heat-sensitive recording material of Comparative Example 2 which includes, as the electron-receiving compound, bisphenol A is extremely bad in point of the image preservability.

TABLE 4

| | Sensitivity | Background Fogging | Image Preservability | Inkjet Ink Resistance |
|---|---|---|---|---|
| Example 34 | 1.23 | 0.09 | 85 | 88 |
| Example 35 | 1.25 | 0.08 | 87 | 90 |
| Example 36 | 1.26 | 0.09 | 86 | 92 |
| Example 37 | 1.25 | 0.08 | 87 | 93 |
| Example 38 | 1.23 | 0.08 | 88 | 95 |
| Example 39 | 1.23 | 0.08 | 87 | 94 |
| Example 40 | 1.25 | 0.08 | 85 | 95 |
| Example 41 | 1.25 | 0.08 | 87 | 95 |
| Example 42 | 1.26 | 0.08 | 88 | 96 |
| Example 43 | 1.29 | 0.08 | 90 | 97 |
| Example 44 | 1.26 | 0.07 | 88 | 98 |
| Example 45 | 1.26 | 0.08 | 90 | 97 |
| Example 46 | 1.26 | 0.08 | 91 | 98 |
| Example 47 | 1.25 | 0.08 | 88 | 95 |
| Comparative Example 3 | 1.28 | 0.10 | 50 | 50 |
| Example 48 | 1.28 | 0.08 | 80 | 78 |

As is obvious from Table 4, the heat-sensitive recording materials that include, as the electron-receiving compound, N-(4-hydroxyphenyl)-p-toluenesulfonamide, and have a protective layer including an inorganic pigment and a water-soluble polymer all have high sensitivity, good background fogging resistance, good image preservability and good inkjet ink resistance. However, the heat-sensitive recording material of Comparative Example 3 which has the same protective layer as in those but includes, as the electron-receiving compound, bisphenol A is not good in point of the inkjet ink resistance, the background fogging resistance and the image preservability. The heat-sensitive recording material of Example 48 which includes the electron-receiving compound defined herein but does not has a protective layer is not so good in point of the image preservability and the inkjet ink resistance, through its sensitivity is high and its background fogging resistance is good.

TABLE 5

| | Sensitivity | Background Fogging | Image Preservability |
|---|---|---|---|
| Example 49 | 1.25 | 0.09 | 80 |
| Example 50 | 1.25 | 0.07 | 85 |
| Example 51 | 1.25 | 0.07 | 83 |
| Example 52 | 1.29 | 0.07 | 84 |
| Example 53 | 1.28 | 0.07 | 83 |
| Example 54 | 1.28 | 0.06 | 85 |
| Example 55 | 1.27 | 0.06 | 83 |
| Example 56 | 1.25 | 0.07 | 83 |

TABLE 5-continued

| | Sensitivity | Background Fogging | Image Preservability |
|---|---|---|---|
| Comparative Example 4 | 1.30 | 0.12 | 30 |
| Example 57 | 1.25 | 0.07 | 85 |
| Comparative Example 5 | 1.30 | 0.08 | 50 |

As is obvious from the data in Table 5, the heat-sensitive recording materials of the invention all have high sensitivity, good background fogging resistance and good color image preservability, though having, as the support, recycled paper consisting essentially of waste pulp. As opposed to these, the material having, as the support, such recycled paper but including, as the developer, bisphenol A is not good in point of the background fogging resistance and the image preservability. Even though its support is made of woodfree paper, the material including, as the developer, bisphenol A is often not good in point of the image preservability.

TABLE 6

| | Sensitivity | Background Fogging | Image preserv-ability | Chemical Resistance | Sticking Resistance |
|---|---|---|---|---|---|
| Example 58 | 1.31 | 0.07 | 88 | ○ | ○ |
| Example 59 | 1.29 | 0.07 | 86 | ○ | ○ |
| Example 60 | 1.27 | 0.07 | 87 | ○ | ○ |
| Example 61 | 1.28 | 0.08 | 86 | ○ | ○ |
| Example 62 | 1.28 | 0.08 | 70 | ○ | ○ |
| Example 63 | 1.28 | 0.06 | 71 | Δ | ○ |
| Example 64 | 1.27 | 0.08 | 88 | ○ | Δ |
| Example 65 | 1.28 | 0.06 | 61 | ○ | ○ |
| Example 66 | 1.28 | 0.08 | 87 | Δ | ○ |
| Example 67 | 1.25 | 0.08 | 92 | ○ | ○ |
| Example 68 | 1.22 | 0.12 | 30 | Δ | ○ |
| Example 69 | 1.24 | 0.09 | 38 | Δ | ○ |
| Example 70 | 1.21 | 0.09 | 28 | Δ | ○ |
| Comparative Example 6 | 1.32 | 0.08 | 70 | X | Δ |
| Example 71 | 1.28 | 0.08 | 32 | Δ | X |
| Example 72 | 1.18 | 0.08 | 85 | ○ | ○ |

From Table 6, it is understood that the heat-sensitive recording materials of Examples 58 to 66 of the invention all have high sensitivity, good background fogging resistance, good color image preservability, good chemical resistance and good sticking resistance.

The data in Example 58 are compared with those in Examples 63 and 65, and it is understood that, when the amount of the image stabilizer in the heat-sensitive recording materials is not smaller than 10 parts by weight, especially not smaller than 20 parts by weight relative to the electron-donating leuco-dye therein, the image preservability and the chemical resistance of the materials are especially good. The data in Example 58 are compared with those in Example 64, and it is understood that, when the image stabilizer content of the heat-sensitive recording material is not larger than 60 parts by weight, the sticking resistance thereof is especially good.

When the data in Example 58 are compared with those in Example 66, it is understood that the heat-sensitive recording material in which the heat-sensitive color-forming layer was formed by the use of a curtain coater has higher sensitivity, better background fogging resistance and better image preservability.

When the data in Example 63 are compared with those in Example 67, it is understood that the heat-sensitive recording material coated with a protective layer has better image preservability and better chemical resistance.

As opposed to these, the heat-sensitive recording material of Example 68 not including 2-benzyloxynaphthalene is not good in point of the background fog resistance and the image preservability, as in Table 6. The heat-sensitive recording material of Example 69 in which the ratio by weight of 2-benzyloxynaphthalene to methylolstearic acid amide does not fall between 95/5 and 40/60 is not so good in point of the image preservability. The heat-sensitive recording material of Example 70 which does not include an image stabilizer is not also so good in point of the image preservability.

The heat-sensitive recording material of Comparative Example 6 which includes, as the electron-receiving compound, bisphenol A is not good in point of the image preservability and the sticking resistance, and, in addition, its chemical resistance is extremely poor. The heat-sensitive recording material of Example 71 in which the image stabilizer is neither 1,1,3-tris(2-methyl-4-hydroxy-5-tert-butylphenyl)butane nor 1,1,3-tris(2-methyl-4-hydroxy-5-cyclohexylphenyl)butane is not so good in point of the image preservability and the sticking resistance.

What is claimed is:

1. A heat-sensitive recording material comprising support having disposed thereon a heat-sensitive color-forming layer that includes an electron-donating leuco-dye and an electron-receiving compound, wherein the heat-sensitive color-forming layer includes N-(4-hydroxyphenyl)-p-toluenesulfonamide as the electron-receiving compound and includes a sensitizer of 2-benzyloxynaphthalene.

2. The heat-sensitive recording material of claim 1, wherein the amount of the sensitizer is 75 to 200 parts by weight relative to 100 parts by weight of the N-(4-hydroxyphenyl)-p-toluenesulfonamide.

3. The heat-sensitive recording material of claim 1, wherein the electron-donating leuco-dye is at least one selected from 2-anilino-3-methyl-6-diethylaminofluoran, 2-anilino-3-methyl-6-(N-ethyl-N-isoamylamino)fluoran and 2-anilino-3-methyl-6-(N-ethyl-N-propylamino)fluoran.

4. heat-sensitive recording material of claim 1, wherein the heat-sensitive color-forming layer includes an inorganic pigment of calcite-type precipitated calcium carbonate light and/or aluminum hydroxide.

5. The heat-sensitive recording material of claim 4, wherein the amount of the inorganic pigment is 50 to 250 parts by weight relative to 100 parts by weight of the electron-receiving compound.

6. The heat-sensitive recording material of claim 4, wherein the inorganic pigment has a volume-average particle size of 0.6 to 2.5 $\mu$m.

7. The heat-sensitive recording material of claim 4, wherein the support has an undercoat layer including calcined kaolin with a degree of oil absorption of the calcined kaolin being 70 to 80 ml/100 g when measured according to JIS-K5101, and the undercoat layer is formed by blade coating.

8. The heat-sensitive recording material of claim 1, wherein the heat-sensitive color-forming layer includes an adhesive of polyvinyl alcohol having a degree of saponification of 85 to 99 mol % and a degree of polymerization of 200 to 2000.

9. The heat-sensitive recording material of claim 8, wherein the amount of the polyvinyl alcohol is 70 to 200 parts by weight relative to 100 parts by weight of the electron-donating leuco-dye.

10. The heat-sensitive recording material of claim 8, wherein the polyvinyl alcohol comprises at least one selected from sulfo-modified polyvinyl alcohol, diacetone-modified polyvinyl alcohol and acetoacetyl-modified polyvinyl alcohol.

11. The heat-sensitive recording material of claim 1, wherein a protective layer is disposed on the heat-sensitive color-forming layer, wherein the protective layer includes an inorganic pigment and a water-soluble polymer.

12. The heat-sensitive recording material of claim 11, wherein the inorganic pigment comprises aluminium hydroxide and/or kaolin.

13. The heat-sensitive recording material of claim 11, wherein the water-soluble polymer comprises at least one selected from polyvinyl alcohol, oxidized starch and urea phosphate-modified starch.

14. The heat-sensitive recording material of claim 11, wherein the water-soluble polymer includes polyvinyl alcohol, and oxidized starch and/or urea phosphate-modified starch in a ratio by weight falling between 90/10 and 10/90.

15. The heat-sensitive recording material of claim 11, wherein the inorganic pigment comprises aluminium hydroxide having a mean particle size of 0.5 to 0.9 $\mu$m.

16. The heat-sensitive recording material of claim 11, wherein the polyvinyl alcohol comprises at least one selected from silicon-modified polyvinyl alcohol, diacetone-modified polyvinyl alcohol, acetoacetyl -modified polyvinyl alcohol and amide-modified polyvinyl alcohol.

17. The heat-sensitive recording material of claim 1, wherein the support comprises essentially waste pulp.

18. The heat-sensitive recording material of claim 17, wherein the heat-sensitive color-forming layer further includes a basic pigment.

19. The heat-sensitive recording material of claim 18, wherein the basic pigment comprises at least one selected from burr-like calcium carbonate, aluminium hydroxide, basic magnesium carbonate and magnesium oxide.

20. A heat-sensitive recording material comprising a support having disposed thereon a heat-sensitive color-forming layer that includes an electron-donating leuco-dye and an electron-receiving compound, wherein the heat-sensitive color-forming layer includes N-(4-hydroxyphenyl)-p-toluenesulfonamide as the electron-receiving compound, and includes, as a sensitizer, 2-benzyloxynaphthalene and methylolstearic acid amide, with a ratio (x/y) of the 2-benzyloxynaphthalene (x) to the methylolstearic acid amide (y) being 95/5 to 40/60, and includes, as an image stabilizer, 1,1,3-tris(2-methyl-4-hydroxy-5-tert-butylphenyl)butane and/or 1,1,3-tris(2-methyl-4-hydroxy-5-cyclohexylphenyl)butane.

21. The heat-sensitive recording material of claim 20, wherein the amount of the image stabilizer is 10 and 100 parts by weight relative to 100 parts by weight of the electron-donating leuco-dye.

* * * * *

UNITED STATES PATENT AND TRADEMARK OFFICE

CERTIFICATE OF CORRECTION

PATENT NO. : 6,642,175 B2 
DATED : November 4, 2003
INVENTOR(S) : Hirofumi Mitsuo, Tsutomu Watanabe and Masayuki Iwasaki It is certified that error appears in the above-identified patent and that said Letters Patent is hereby corrected as shown below:

Title page,
Item [56], References Cited, FOREIGN PATENT DOCUMENTS, please delete "EP 0 138 517 A2 10/2001" please insert -- EP 1 138 517 A2 10/2001 --

Signed and Sealed this

Ninth Day of March, 2004

JON W. DUDAS
*Acting Director of the United States Patent and Trademark Office*